US009093056B2

(12) United States Patent
Pardo et al.

(10) Patent No.: US 9,093,056 B2
(45) Date of Patent: Jul. 28, 2015

(54) AUDIO SEPARATION SYSTEM AND METHOD

(75) Inventors: Bryan Pardo, Evanston, IL (US); Zafar Rafii, Evanston, IL (US)

(73) Assignee: NORTHWESTERN UNIVERSITY, Evanston, IL (US)

( * ) Notice: Subject to any disclaimer, the term of this patent is extended or adjusted under 35 U.S.C. 154(b) by 378 days.

(21) Appl. No.: 13/612,413

(22) Filed: Sep. 12, 2012

(65) Prior Publication Data

US 2013/0064379 A1 Mar. 14, 2013

Related U.S. Application Data

(60) Provisional application No. 61/534,280, filed on Sep. 13, 2011.

(51) Int. Cl.

| | |
|---|---|
| ***H04R 29/00*** | (2006.01) |
| ***G10H 1/00*** | (2006.01) |
| *H04S 3/00* | (2006.01) |
| *H04S 7/00* | (2006.01) |

(52) U.S. Cl.

CPC ..... *G10H 1/0008* (2013.01); *H04S 7/40* (2013.01); *G10H 2210/051* (2013.01); *G10H 2210/066* (2013.01); *G10H 2250/135* (2013.01); *G10H 2250/235* (2013.01); *G10H 2250/641* (2013.01); *H04S 3/008* (2013.01); *H04S 7/30* (2013.01); *H04S 2400/15* (2013.01); *H04S 2420/07* (2013.01)

(58) Field of Classification Search

None

See application file for complete search history.

(56) References Cited

U.S. PATENT DOCUMENTS

| | | | | |
|---|---|---|---|---|
| 6,766,523 | B2 | 7/2004 | Herley | |
| 7,415,392 | B2 * | 8/2008 | Smaragdis | 702/190 |
| 7,461,392 | B2 | 12/2008 | Herley | |
| 7,523,474 | B2 | 4/2009 | Herley | |
| 7,612,275 | B2 * | 11/2009 | Seppanen et al. | 84/600 |
| 7,653,921 | B2 | 1/2010 | Herley | |
| 7,912,232 | B2 * | 3/2011 | Master | 381/94.3 |
| 2002/0181711 | A1 * | 12/2002 | Logan et al. | 381/1 |
| 2008/0300702 | A1 | 12/2008 | Gomez et al. | |
| 2010/0138010 | A1 * | 6/2010 | Aziz Sbai et al. | 700/94 |
| 2011/0061516 | A1 * | 3/2011 | Kim et al. | 84/625 |
| 2012/0291611 | A1 * | 11/2012 | Kim et al. | 84/615 |

OTHER PUBLICATIONS

H. Schenker, Harmony. University of Chicago Press, 1954.

(Continued)

*Primary Examiner* — Brenda Bernardi

(74) *Attorney, Agent, or Firm* — Hanley, Flight and Zimmerman, LLC

(57) ABSTRACT

A method includes determining a first spectrogram of the audio signal, defining a similarity matrix of the audio signal based on the first spectrogram and a transposed version of the first spectrogram, identifying two or more similar frames in the similarity matrix that are more similar to a designated frame than to one or more other frames in the similarity matrix, creating a repeating spectrogram model based on the two or more similar frames that are identified in the similarity matrix, and deriving a mask based on the repeating spectrogram model and the first spectrogram of the audio signal. The mask is representative of similarities between the repeating spectrogram model and the first spectrogram of the audio signal. The method also includes extracting a repeating structure from the audio signal by applying the mask to the audio signal.

24 Claims, 12 Drawing Sheets
(10 of 12 Drawing Sheet(s) Filed in Color)

(56) References Cited

OTHER PUBLICATIONS

N. Ruwet and M. Everist, "Methods of analysis in musicology," Music Analysis, vol. 6, No. 1/2, pp. 3-9+11-36, Mar.-Jul. 1987.
A. Ockelford, Repetition in Music: Theoretical and Metatheoretical Perspectives. Ashgate Publishing, 2005, vol. 13 of Royal Musical Association monographs.
J. Foote, "Visualizing music and audio using self-similarity," in 7th ACM International Conference on Multimedia (Part 1), Orlando, FL, USA, Oct. 30-Nov. 5, 1999, pp. 77-80.
M. Cooper and J. Foote, "Automatic music summarization via similarity analysis," in 3rd International Conference on Music Information Retrieval, Paris, France, Oct. 13-17, 2002, pp. 81-85.
A. Pikrakis, I. Antonopoulos, and S. Theodoridis, "Music meter and tempo tracking from raw polyphonic audio," in 9th International Conference on Music Information Retrieval, Barcelona, Spain, Oct. 10-14, 2008.
G. Peeters, "Deriving musical structures from signal analysis for music audio summary generation: "sequence" and "state" approach," in Computer Music Modeling and Retrieval, ser. Lecture Notes in Computer Science, U. Wiil, Ed. Springer Berlin / Heidelberg, 2004, vol. 2771, pp. 169-185.
J. Foote, "Automatic audio segmentation using a measure of audio novelty," in IEEE International Conference on Multimedia and Expo, vol. 1, New York, NY, USA, Jul. 30-Aug. 2, 2000, pp. 452-455.
J. Foote and S. Uchihashi, "The beat spectrum: A new approach to rhythm analysis," in IEEE International Conference on Multimedia and Expo, Tokyo, Japan, Aug. 22-25, 2001, pp. 881-884.
M. A. Bartsch, "To catch a chorus using chroma-based representations for audio thumbnailing," in IEEE Workshop on Applications of Signal Processing to Audio and Acoustics, New Paltz, NY, USA, Oct. 21-24, 2001.
R. B. Dannenberg and N. Hu, "Pattern discovery techniques for music audio," Journal of New Music Research, vol. 32, No. 2, pp. 153-164, 2003.
K. Jensen, "Multiple scale music segmentation using rhythm, timbre, and harmony," EURASIP Journal on Advances in Signal Processing, vol. 2007, No. 1, pp. 1-11, Jan. 2010.
R. B. Dannenberg, "Listening to "Naima": An automated structural analysis of music from recorded audio," in International Computer Music Conference, Gothenburg, Sweden, Sep. 17-21, 2002, pp. 28-34.
R. B. Dannenberg and M. Goto, "Music structure analysis from acoustic signals," in Handbook of Signal Processing in Acoustics, D. Havelock, S. Kuwano, and M. Vorl"ander, Eds. Springer New York, 2009, pp. 305-331.
J. Paulus, M. M"uller, and A. Klapuri, "Audio-based music structure analysis," in 11th International Society on Music Information Retrieval, Utrecht, Netherlands, Aug. 9-13, 2010, pp. 625-636.
S. Vembu and S. Baumann, "Separation of vocals from polyphonic audio recordings," in 6th International Conference on Music Information Retrieval, London, UK, Sep. 11-15, 2005, pp. 337-344.
B. Raj, P. Smaragdis, M. Shashanka, and R. Singh, "Separating a foreground singer from background music," in International Symposium on Frontiers of Research on Speech and Music, Mysore, India, May 8-9, 2007.
A. Ozerov, P. Philippe, F. Bimbot, and R. Gribonval, "Adaptation of Bayesian models for single-channel source separation and its application to voice/music separation in popular songs," IEEE Transactions on Audio, Speech, and Language Processing, vol. 15, No. 5, pp. 1564-1578, Jul. 2007.
Y. Li and D. Wang, "Separation of singing voice from music accompaniment for monaural recordings," IEEE Transactions on Audio, Speech, and Language Processing, vol. 15, No. 4, pp. 1475-1487, May 2007.
M. Ryyn"anen, T. Virtanen, J. Paulus, and A. Klapuri, "Accompaniment separation and karaoke application based on automatic melody transcription," in IEEE International Conference on Multimedia & Expo, Hannover, Germany, Jun. 23-26, 2008.
T. Virtanen, A. Mesaros, and M. Ryyn"anen, "Combining pitch-based inference and non-negative spectrogram factorization in separating vocals from polyphonic music," in ISCA Tutorial and Research Workshop on Statistical and Perceptual Audition, Brisbane, Australia, Sep. 21, 2008, pp. 17-20.
K. Dressler, "An auditory streaming approach on melody extraction," in 7th International Conference on Music Information Retrieval (MIREX evaluation), Victoria, Canada, Oct. 8-12, 2006.
C.-L. Hsu and J.-S. R. Jang, "On the improvement of singing voice separation for monaural recordings using the MIR-1K dataset," IEEE Transactions on Audio, Speech, and Language Processing, vol. 18, No. 2, pp. 310-319, Feb. 2010.
J.-L. Durrieu, B. David, and G. Richard, "A musically motivated midlevel representation for pitch estimation and musical audio source separation," IEEE Journal on Selected Topics on Signal Processing, vol. 5, No. 6, pp. 1180-1191, Oct. 2011.
M. Piccardi, "Background subtraction techniques: a review," in IEEE International Conference on Systems, Man and Cybernetics, The Hague, The Netherlands, Oct. 10-13, 2004.
K. Yoshii, M. Goto, and H. G. Okuno, "Adamast: A drum sound recognizer based on adaptation and matching of spectrogram templates," in 5th International Conference on Music Information Retrieval, Barcelona, Spain, Oct. 10-14, 2004, pp. 184-191.
B. Widrow, J. R. Glover, J. M. McCool, J. Kaunitz, C. S. Williams, R. H. Hean, J. R. Zeidler, J. Eugene Dong, and R. C. Goodlin, "Adaptive noise cancelling: Principles and applications," in IEEE, vol. 63, No. 12, Dec. 1975, pp. 1692-1716.
J. H. McDermott, D. Wrobleski, and A. J. Oxenham, "Recovering sound sources from embedded repetition," Proceedings of the Natural Academy Science of the United States of America, vol. 108, No. 3, pp. 1188-1193, Jan. 18, 2011.
FitzGerald, Derry, Vocal Separation using Nearest Neighbours and Median Filtering. ISSC 2012, NUI Maynooth, Jun. 28-29.
A. Liutkus and P. Leveau, "Separation of music+effects sound track from several international versions of the same movie," in 128th Audio Engineering Society Convention, London, UK, May 22-25, 2010.
C. F'evotte, R. Gribonval, and E. Vincent, "BSS EVAL toolbox user guide," IRISA, Rennes, France, Tech. Rep. 1706, Apr. 2005, http://www.irisa.fr/metiss/bss eval/. (Note—this IP address does not seem to work).
B. Fox, A. Sabin, B. Pardo, and A. Zopf, "Modeling perceptual similarity of audio signals for blind source separation evaluation," in 7th International Conference on Independent Component Analysis, London, UK, Sep. 9-12, 2007, pp. 454-461.
R. J. Weiss and J. P. Bello, "Identifying repeated patterns in music using sparse convolutive non-negative matrix factorization," in 11th International Society for Music Information Retrieval, Utrecht, Netherlands, Aug. 9-13, 2010.
A. Liutkus, Z. Rafii, R. Badeau, B. Pardo, and G. Richard, "Adaptive filtering for music/voice separation exploiting the repeating musical structure," in IEEE International Conference on Acoustics, Speech and Signal Processing, Kyoto, Japan, Mar. 25-30, 2012.
A. de Cheveign'e, "YIN, a fundamental frequency estimator for speech and music," The Journal of the Acoustical Society of America, vol. 111, No. 4, pp. 1917-1930, Apr. 2002.
A. Klapuri, "Multiple fundamental frequency estimation by summing harmonic amplitudes," in 7th International Conference on Music Information Retrieval, Victoria, Canada, Oct. 8-12, 2006, pp. 216-221.
Jean-Louis Durrieu, Bertrand David, and Ga"el Richard. A musically motivated mid-level representation for pitch estimation and musical audio source separation. IEEE Journal on Selected Topics on Signal Processing, 5(6):1180-1191, Oct. 2011.
Derry FitzGerald and Mikel Gainza. Single channel vocal separation using median filtering and factorization techniques. ISAST Transactions on Electronic and Signal Processing, 4(1):62-73, 2010.
Jinyu Han and Ching-Wei Chen. Improving melody extraction using probabilistic latent component analysis. In IEEE International Conference on Acoustics, Speech and Signal Processing, Prague, Czech Republic, May 22-27, 2011.
Alexander Jourjine, Scott Rickard, and O" zgu"r Yilmaz. Blind separation of disjoint orthogonal signals: Demixing n sources from 2 mixtures. In IEEE International Conference on Acoustics, Speech, and Signal Processing, vol. 5, pp. 2985-2988, Istanbul, Turkey, Jun. 5-9, 2000.
Antoine Liutkus, Zafar Rafii, Roland Badeau, Bryan Pardo, and Ga"el Richard. Adaptive filtering for music/voice separation exploiting the repeating musical structure. In IEEE International Conference on Acoustics, Speech and Signal Processing, Kyoto, Japan, Mar. 25-30, 2012.

* cited by examiner

AUDIO SEPARATION SYSTEM AND METHOD

CROSS-REFERENCE TO RELATED APPLICATIONS

This application claims priority to U.S. Provisional Application No. 61/534,280, which was filed on 13 Sep. 2011. The entire disclosure of U.S. Provisional Application No. 61/534,280 is incorporated by reference.

STATEMENT REGARDING FEDERALLY SPONSORED RESEARCH OR DEVELOPMENT

This invention was made with government support under grant numbers IIS0643752, IIS0757544, and IIS0812314 awarded by the National Science Foundation. The government has certain rights in the invention.

BACKGROUND

Repetition can be a core principle in audio recordings such as music. This is especially true for popular songs, generally marked by a noticeable repeating musical structure, over which the singer performs varying lyrics. A typical piece of popular music has generally an underlying repeating musical structure, with distinguishable patterns periodically repeating at different levels, with possible variations.

An important part of music understanding can be the identification of those patterns. To visualize repeating patterns, a two-dimensional representation of the musical structure can be calculated by measuring the similarity and/or dissimilarity between any two instants of the audio, such as in a similarity matrix. Such a similarity matrix can be built from the Mel-Frequency Cepstrum Coefficients (MFCC) (e.g., as described in Jonathan Foote, *Visualizing music and audio using self-similarity*, ACM Multimedia, volume 1, pages 77-80, Orlando, Fla., USA, 30 Oct.-5 Nov. 1999, which is referred to herein as "*Visualizing music*"), the spectrogram (e.g., as described in Jonathan Foote, *Automatic audio segmentation using a measure of audio novelty*, International Conference on Multimedia and Expo, volume 1, pages 452-455, New York, N.Y., USA, 30 Jul.-2 Aug. 2000, which is referred to herein as "*Automatic audio segmentation*"), the chromagram (e.g., as described in Mark A. Bartsch, *To catch a chorus using chroma-based representations for audio thumbnailing*, Workshop on Applications of Signal Processing to Audio and Acoustics, New Paltz, N.Y., USA, 21-24 Oct. 2001, which is referred to herein as Bartsch), or other features such as the pitch contour (melody) (e.g., as described in Roger B. Dannenberg, *Listening to "Naima": An automated structural analysis of music from recorded audio*, International Computer Music Conference, pages 28-34, Gothenburg, Sweden, 17-21 Sep. 2002, which is referred to herein as Dannenberg), depending on the application, as long as similar sounds yield similarity in the feature space in one embodiment.

The similarity matrix can then be used, for example, to compute a measure of novelty to locate relatively significant changes in the audio (e.g., as described in *Automatic audio segmentation*) or to compute a beat spectrum to characterize the rhythm of the audio (e.g., as described in Jonathan Foote and Shingo Uchihashi, *The beat spectrum: A new approach to rhythm analysis*, International Conference on Multimedia and Expo, pages 881-884, Tokyo, Japan, 22-25 Aug. 2001, which is referred to herein as "*The beat spectrum*"). This ability to detect relevant boundaries within the audio can be of great utility for audio segmentation and audio summarization, such as described in *Automatic audio segmentation*, Bartsch, and Dannenberg.

Some known music/voice separation systems first detect vocal segments using some features such as MFCCs, and then apply separation techniques such as Non-negative Matrix Factorization (e.g., Shankar Vembu and Stephan Baumann, *Separation of vocals from polyphonic audio recordings*, International Conference on Music Information Retrieval, pages 337-344, London, UK, 11-15 Sep. 2005, which is referred to herein as Vembu), pitch-based inference (e.g., as described in Yipeng Li and DeLiang Wang, *Separation of singing voice from music accompaniment for monaural recordings*, IEEE International Conference on Acoustics, Speech, and Signal Processing, 15(4):1475-1487, May 2007, which is referred to herein as "Li and Wang," and/or in Chao-Ling Hsu and Jyh-Shing Roger Jang, *On the improvement of singing voice separation for monaural recordings using the MIR-IK dataset*, IEEE Transactions on Audio, Speech, and Language Processing, 18(2):310-319, February 2010, which is referred to herein as "Hsu and Jang"), and/or adaptive Bayesian modeling (e.g., as described in Alexey Ozerov, Pierrick Philippe, Frédéric Bimbot, and Rémi Gribonval, *Adaptation of bayesian models for single-channel source separation and its application to voice/music separation in popular songs*, IEEE Transactions on Audio, Speech, and Language Processing, 15(5): 1561-1578, July 2007, which is referred to herein as "Ozerov").

Some of the known separation systems and methods, however, are not without drawbacks. First, some systems and methods may rely on particular or predesignated features in audio recordings in order to separate the components (e.g., music and vocals) from the recordings. If the features are not present and/or the features must first be computed in order to separate the components of the audio recording, then the components may not be able to be accurately separated. Second, some systems and methods rely on relatively complex frameworks having significant computational costs. Third, some systems and methods must be previously trained to separate components of an audio recording, such as by learning statistical models of sound sources (e.g., a model of a person's voice) from a training database.

A need exists for a system and method that can separate components with repeating patterns from an audio recording, such as a musical accompaniment from a singing voice or a periodic interference from a corrupted signal, while avoiding or reducing the impact of one or more of the above shortcomings of some known systems and methods.

BRIEF DESCRIPTION

In accordance with one embodiment, a system is provided that is configured to separate first and second components of an audio recording from each other by identifying a repeating structure in the audio recording, segmenting the audio recording into segments based on the repeating structure, generating a repeating segment model based on the segments of the audio recording, and identifying at least one of the first component or the second component of the audio recording by comparing the audio recording to the repeating segment model.

In another embodiment, a method is provided that includes identifying a repeating structure in the audio recording, segmenting the audio recording into segments based on the repeating structure, generating a repeating segment model based on the segments of the audio recording, and identifying at least one of the first component or the second component of the audio recording by comparing the audio recording to the repeating segment model. In one aspect, the repeating segment model is used on a mixture spectrogram of the audio recording, such as by comparing or applying (e.g., multiplying or dividing) the mixture spectrogram by the repeating segment model to generate a full repeating spectrogram model. This full repeating spectrogram model can then be used to derive a time-frequency mask that is employed to identify the first and/or second repeating components of the audio recording.

In another embodiment, a method (e.g., for extracting repeating in an audio signal) includes identifying a temporal period of a repeating structure in an audio signal, segmenting the audio signal into plural segments based on the temporal period of the repeating structure, generating a repeating segment model that represents the repeating structure based on the segments of the audio signal, comparing the repeating segment model to the audio signal to form a mask, and extracting the repeating structure from the audio signal by applying the mask to the audio signal. In one aspect, the repeating spectrogram model is used on a mixture spectrogram of the audio signal, such as by comparing or applying (e.g., multiplying or dividing) the mixture spectrogram by the repeating spectrogram model to generate a full repeating spectrogram model. This full repeating spectrogram model can then be used to derive the mask.

In another embodiment, a system (e.g., an audio extraction system) includes an identification module, a segmentation module, and a masking module. The identification module is configured to identify a temporal period of a repeating structure in an audio signal. The segmentation module is configured to segment the audio signal into plural segments based on the temporal period of the repeating structure. The segmentation module also is configured to generate a repeating segment model that represents the repeating structure based on the segments of the audio signal. The masking module is configured to compare the repeating segment model to the audio signal to form a mask and to extract the repeating structure from the audio signal by applying the mask to the audio signal. In one aspect, the segmentation module is configured to use the repeating spectrogram model on a mixture spectrogram of the audio signal, such as by comparing or applying (e.g., multiplying or dividing) the mixture spectrogram by the repeating spectrogram model to generate a full repeating spectrogram model. This full repeating spectrogram model can then be used by the masking module to derive the mask.

In another embodiment, a computer readable storage medium comprising one or more sets of instructions is provided. The one or more sets of instructions are configured to direct a processor of a system (e.g., an audio extraction system) to identify a temporal period of a repeating structure in an audio signal, segment the audio signal into plural segments based on the temporal period of the first repeating structure, generate a repeating segment model that represents the repeating structure based on the segments of the audio signal, compare the repeating segment model to the audio signal to form a mask, and extract the repeating structure from the audio signal by applying the mask to the audio signal. In one aspect, the sets of instructions are configured to direct the processor to use the repeating spectrogram model on a mixture spectrogram of the audio signal, such as by comparing or applying (e.g., multiplying or dividing) the mixture spectrogram by the repeating spectrogram model to generate a full repeating spectrogram model. This full repeating spectrogram model can then be used by the processor to derive the mask.

In another embodiment, a method (e.g., for extracting repeating or similar structure from an audio signal) includes determining a first spectrogram of the audio signal, defining a similarity matrix of the audio signal based on the first spectrogram and a transposed version of the first spectrogram, identifying two or more similar frames in the similarity matrix that are more similar to a designated frame than to one or more other frames in the similarity matrix, creating a repeating spectrogram model based on the two or more similar frames that are identified in the similarity matrix, and deriving a mask based on the repeating spectrogram model and the first spectrogram of the audio signal. The mask is representative of similarities between the repeating spectrogram model and the first spectrogram of the audio signal. The method also includes extracting a repeating structure from the audio signal by applying the mask to the audio signal. The similarity matrix can be defined using a magnitude spectrogram and cosine similarity measurement. Additionally or alternatively, the similarity matrix can be defined using one or more other features, such as Mel Frequency Cepstrum Coefficients (MFCCs), a chromagram, and/or other metrics (e.g., Euclidean distance, dot product, and the like).

In another embodiment a system (e.g., an audio separation system) includes an identification module and a masking module. The identification module is configured to determine a first spectrogram of an audio signal, define a similarity matrix of the audio signal based on the first spectrogram and a transposed version of the first spectrogram, and identify two or more similar frames in the similarity matrix that are more similar to a designated frame than to one or more other frames in the similarity matrix. The identification module also is configured to create a repeating spectrogram model based on the two or more similar frames that are identified in the similarity matrix. The masking module is configured to derive a mask based on the repeating spectrogram model and the first spectrogram of the audio signal. The mask is representative of similarities between the repeating spectrogram model and the first spectrogram of the audio signal. The masking module is further configured to extract a repeating structure from the audio signal by applying the mask to the audio signal.

In another embodiment, a computer readable storage medium comprising one or more sets of instructions configured to direct a processor of a system (e.g., an audio separation system) to determine a first spectrogram of an audio signal, define a similarity matrix of the audio signal based on the first spectrogram and a transposed version of the first spectrogram, identify two or more similar frames in the similarity matrix that are more similar to a designated frame than to one or more other frames in the similarity matrix, create a repeating spectrogram model based on the two or more similar frames that are identified in the similarity matrix, and derive a mask based on the repeating spectrogram model and the first spectrogram of the audio signal. The mask is representative of similarities between the repeating spectrogram model and the first spectrogram of the audio signal. The one or more sets of instructions also are configured to direct the processor to extract a repeating structure from the audio signal by applying the mask to the audio signal.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The subject matter described herein will be better understood from reading the following description of non-limiting embodiments, with reference to the attached drawings, wherein below.

DETAILED DESCRIPTION

Figure 1:
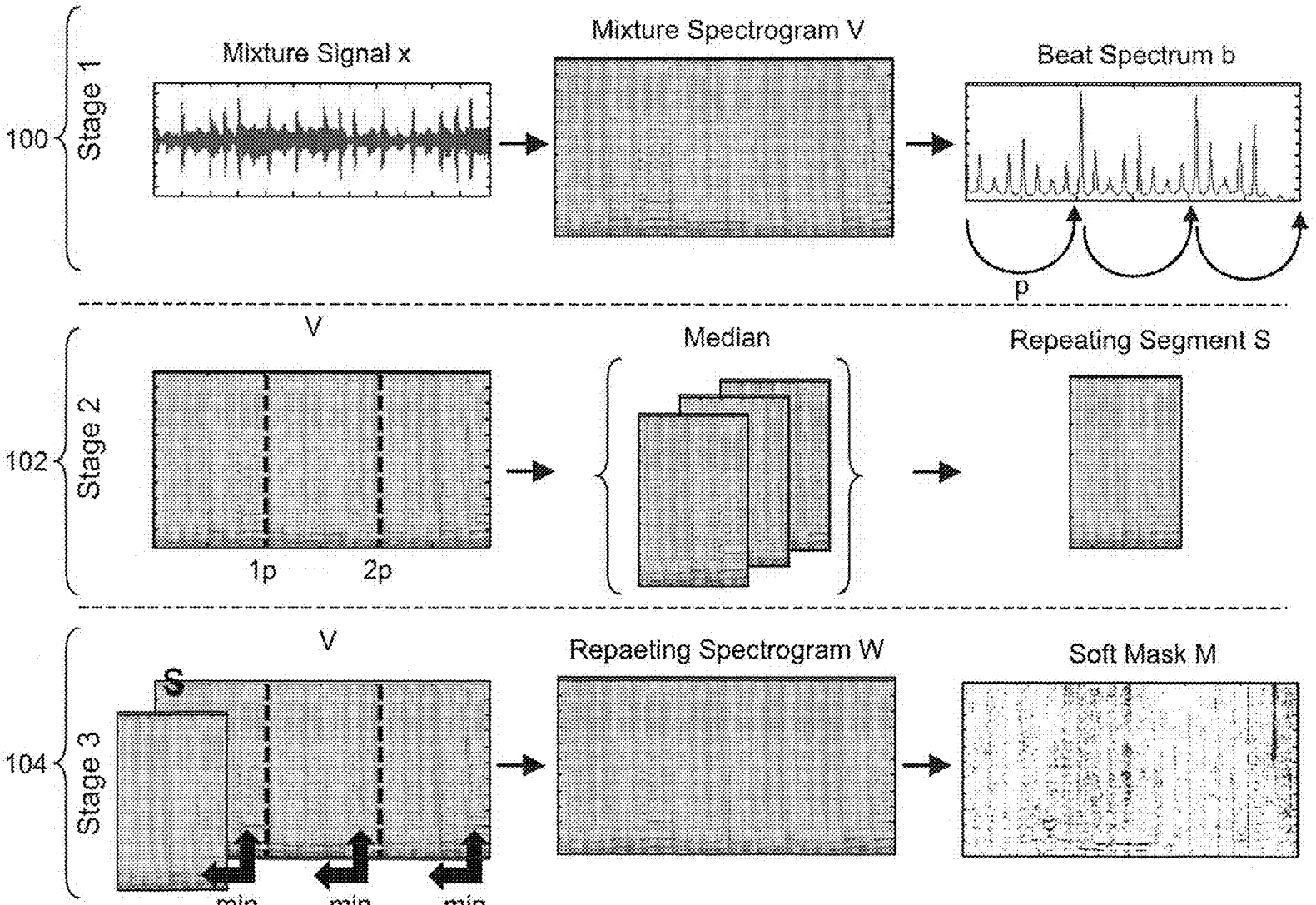
FIG. 1 provides an overview of the stages used by an acoustic separation system to identify and/or extract repeating structure from an audio signal in accordance with one embodiment.

In one embodiment, a method for separating music and voice (or other components of an audio recording) is provided by extracting repeating audio structure in an audio recording. First, a period of a repeating structure may be found in the recording. Then, a spectrogram of the recording is segmented at period boundaries and the segments are averaged to create a repeating segment model. Each time-frequency bin in a segment is compared to the model, and a mixture of the recording is partitioned using binary time-frequency masking by labeling bins that are similar to the model as the repeating background. Evaluation on a dataset of 1,000 song clips showed that, in one embodiment, this method can improve on the performance of an existing music/voice separation method without depending on particular audio representations (e.g. mel frequency cepstral coefficients) or complex frameworks.

The method used to separate components (such as music and voice) from an audio recording may be referred to herein as the Repeating Pattern Extraction Technique (REPET) algorithm. The REPET algorithm can be used to identify repeating patterns in an audio signal and extract the repeating patterns. For example, if a song has a musical background which seems to periodically repeat, the REPET algorithm can identify the underlying repeating structure and extract it from the overlying varying vocals.

Unlike one or more other known approaches to separating components of an audio recording, at least one embodiment of the REPET algorithm may not depend on particular or predesignated features of an audio recording, may not rely on complex frameworks, and/or may not need prior training to recognize the different components of a recording. Because the REPET algorithm may only be based on self-similarity (e.g., degrees or measurements of similarity) between the repeating segments, the REPET algorithm may work on a variety of audio signals having one or more repeating patterns within the recording.

In one embodiment, the REPET algorithm identifies groups of bins that seem to repeat in a spectrogram and extract the repeating bins using a masking approach. This can be achieved by identifying the repeating patterns or by computing a "repeating spectrum" to reveal segmentation of the underlying repeating structure. Then, the REPET algorithm can build a repeating pattern model by taking the mean, the median, the mode, or some other statistical measure of the repeating patterns, bin-wise (e.g., by taking the mean, median, mode, or other measure across several bins of repeating patterns). The REPET algorithm can extract the repeating patterns by comparing the repeating patterns to each other and extracting the bins that seem to repeat by using a masking approach. The REPET algorithm may be applied to single as well as multichannel signals.

The REPET algorithm can be useful for audio analysis and/or sound separation. The REPET algorithm may be used for instrument or vocalist identification, music or voice transcription, audio post-production, sample-based musical composition, and the like. The REPET algorithm can be useful in karaoke software where the input data is a song having both music and vocal components, and the output data is the song without the vocals, or an audio analyzer which could break a musical piece down into individual elements for remixing purposes.

While the discussion herein may focus on a melodic song as the audio recording, not all embodiments are limited to music. One or more embodiments described herein may be applicable to audio recordings other than music, and the term "song" should be interpreted to include such recordings unless specifically excluded. Periodicities in an audio signal can be found by using an autocorrelation function, which measures the similarity between a segment and a lagged version of the segment over one or more successive time intervals.

FIG. 1 provides an overview of the stages used by an audio extraction system 1700 (shown in FIG. 17) to identify and/or extract repeating structure (e.g., a pattern or segment that is repeated one or more times) from an audio signal in accordance with one embodiment. The first stage is shown in a first or upper row 100 and includes calculation of a beat spectrum b and estimation of a repeating period p. The second stage is shown in a second or middle row 102 and includes segmentation of a mixture spectrogram V and computation of a repeating segment model S. The third stage is shown in a third or lower row 104 and includes derivation of a repeating spectrogram model W and building of a soft time-frequency mask M. Embodiments of these stages are described below.

A repeating period p from the beat spectrum b is shown. The second, or middle, row 102 of FIG. 1 illustrates segmentation of the spectrogram V to get a mean repeating segment $\overline{V}$. The third, or bottom, row 104 of FIG. 1 illustrates bin-wise division of V by $\overline{V}$ to get a binary time-frequency mask M.

One example of the method for extracting repeating structure from an audio signal includes three stages: identification of a repeating period in the audio signal, modeling of a repeating segment in the audio signal, and extraction of a repeating structure from the audio signal.

Periodicities in a signal can be found by using the autocorrelation, which measures the similarity between a segment and a lagged version of itself over successive time intervals. In one embodiment, given a mixture signal $\chi$ (e.g., an audio signal), a Short-Time Fourier Transform (STFT) X of the signal is calculated, using half-overlapping Hamming windows of N samples. A magnitude spectrogram V is derived by taking an absolute value of the elements of the STFT X, after discarding a symmetric part, while keeping the DC component. The autocorrelation of each row (e.g., frequency) of a power spectrogram $V^2$ (e.g., element-wise square of the magnitude spectrogram V) and obtain a matrix B. The power spectrogram $V^2$ can be used to emphasize the appearance of peaks of periodicity in the matrix B. If the mixture signal $\chi$ is a stereo signal, the power spectrogram $V^2$ can e averaged over the channels. An overall acoustic self-similarity b of mixture signal $\chi$ can be obtained by taking the mean over the rows (e.g., frequencies) of the matrix B. The self-similarity b can be normalized by a first term (e.g., lag 0). The calculation of the self-similarity b is shown in Equation 1. The self-similarity b also may be referred to as a beat spectrum. In one embodiment, no similarity matrix is calculated and/or a dot product is used in lieu of a cosine similarity when determining the self-similarity b.

$$B(i, j) = \frac{1}{m-j+1}\sum_{k=1}^{m-j+1} V(i,k)^2 V(i,k+j-1)^2 \tag{1}$$

$$b(j) = \frac{1}{n}\sum_{i=1}^{n} B(i, j) \text{ then } b(j) = \frac{b(j)}{b(1)}$$

for $i = 1 \ldots n$ (frequency) where $n = N/2 + 1$ for $j = 1 \ldots m$ (lag) where $m = \#$ time frames Once the beat spectrum b is calculated, the first term which measures the similarity of the audio signal with itself (e.g., lag 0) may be discarded. If repeating patterns are present in the mixture signal $\chi$, the beat spectrum b may form peaks that are periodically repeating at different levels, which can reveal the underlying hierarchical repeating structure of the mixture signal $\chi$, as shown in the top row of FIG. 1 (described below).

In one embodiment, the repeating period p of the repeating structure in the mixture signal $\chi$ can be automatically estimated by determining which period in the beat spectrum b has the highest mean accumulated energy over its integer multiples, or a mean accumulated energy that is greater than one or more other periods. For each possible period j in the beat spectrum b, a check is performed on the integer multiples i (e.g., j, 2j, 3j, etc.) to determine if the multiples correspond to the highest or larger peaks in the respective sections of the beat spectrum b, such as the sections represented by $[i-\Delta, i+\Delta]$, where $\Delta$ is a variable distance parameter and can be a function of j. If the integer multiples correspond with the peaks, the values of the peaks may be summed and the mean of the given neighborhood can be subtracted to filter out one or more components of the mixture signal $\chi$, such as "noisy background."

This sum can then be divided by a total number of integer multiples of j that are found in the beat spectrum b, which leads to a mean energy value for each period j. The repeating period p can be defined as the period j that provides the largest mean value, or a mean value that is larger than one or more mean values. This helps to find the period of the strongest or stronger repeating peaks in the beat spectrum b, which correspond to the period of the underlying repeating structure in the mixture signal $\chi$, while avoiding lower-order errors (e.g., periods of smaller repeating patterns) and/or higher-order errors (e.g., multiples of the repeating period). Longer or the longest lag terms of the autocorrelation may be unreliable, because with increasing time, fewer coefficients may e used to compute the similarity. Therefore, in one embodiment, the values in the longest ¼ of lags in the beat spectrum b may be ignored. The period p can selected from those periods identified in the beat spectrum b that are associated with at least a designated number (such as three) of full cycles in the remaining portion of the beat spectrum b.

In one embodiment, the distance parameter $\Delta$ is set to a designated number that is based on the period, such as $\lfloor 3j/4 \rfloor$ for each possible period j, where $\lfloor \bullet \rfloor$ represents the floor junction. This creates a window around a peak that is relatively wide, but not so wide that the peak includes other peaks at multiples of the period j. Because of tempo deviations, the repeating peaks in the beat spectrum b may not be exact integer multiples of j. As a result, in one embodiment, a fixed deviation parameter $\delta$ is introduced. This parameter can be set to a designated number, such as 2 lags. This means that when looking for the highest or a higher peak in the neighborhood $[i-\Delta, i+\Delta]$, the value of the corresponding integer multiple i may be assumed to be the maximum of the local interval $[i-\delta, i+\delta]$.

Alternatively, another method or technique may be used to identify the period of the audio signal. For example, another algorithm, software, or process may be used to determine the repeating period p.

Once the repeating period p is obtained (e.g., estimated from the beat spectrum b or obtained in another manner), the period p is used time-segment the spectrogram V into r segments of length p. The spectrogram V may be evenly divided into the r segments. A repeating segment model S can be defined as an element-wise median of the r segments, as shown in the second row 102 of FIG. 1. One embodiment of the calculation of the repeating segment model S is shown in Equation 2.

$$S(i, l) = \underset{k=1 \ldots r}{\text{median}}\{V(i, l + (k-1)p)\} \tag{2}$$

for $i = 1 \ldots n$ (frequency) and $l = 1 \ldots p$ (time)

where $p$ = period length and $r = \#$ segments

One rationale is that, assuming that the non-repeating foreground in the mixture signal $\chi$ (e.g., the voice portion of the audio signal) has a sparse and/or varied time-frequency representation compared with the time-frequency representation of the repeating background (e.g., the music or non-vocal portions of the audio signal), time-frequency bins with little deviation at period p can constitute a repeating pattern and can be captured by the median model. Accordingly, time-frequency bins with large deviations at period p may represent a non-repeating pattern and can be removed by the median model.

The median may be a geometrical mean as this can lead to a better discrimination between repeating and non-repeating patterns. One example of segmentation of the mixture spectrogram V and the computation of the repeating segment model S are illustrated in the second row 102 of FIG. 1.

Once the repeating segment model S is determined, the model S can be used to derive a repeating spectrogram model W, such as by taking the element-wise minimum between the model S and each of the r segments of the spectrogram V, as shown in the third row 106 of FIG. 1. If the nonnegative spectrogram V is assumed to be the sum of a non-negative repeating spectrogram W and a non-negative non-repeating spectrogram V-W, then Wean be less than or equal to V, element-wise, hence the use of the minimum function. One embodiment of the calculation of the repeating spectrogram model W is shown in Equation 3.

$$W(i,l+(k-1)p)=\min\{S(i,l),V(i,l+(k-1)p\} \text{ for } i=1\ldots n,\ l=1\ldots p, \text{ and } k=1\ldots r \quad (3)$$

Once the repeating spectrogram model W is calculated, the model W can be used to derive a soft time-frequency mask M, such as by normalizing the model W by the spectrogram V, element-wise. The idea is that time-frequency bins that are likely to repeat at period p in the spectrogram V will have values near 1 in the mask M and will be weighted toward the repeating background, while time-frequency bins that are not likely to repeat at period p in the spectrogram V would have values near 0 in the mask M and would be weighted toward the non-repeating foreground. One example of a calculation of the soft time-frequency mask M is shown in Equation 4.

$$M(i,j)=\frac{W(i,j)}{V(i,j)} \text{ with } M(i,j)\in[0,1] \quad (4)$$

$$\text{for } i=1\ \ldots\ n \text{ (frequency) and } j=1\ \ldots\ m\text{(time)}$$

Alternatively, the mask M may be determined in another manner, such as by using a Gaussian radical basis function that allows mapping of the period p to an interval [0, 1]. For example, the mask M may be determined from the following Equation #5:

$$M(f,t)=\exp\left(-\frac{(\log X(f,t)-\log\hat{B}(f,t))^2}{2\lambda^2}\right) \quad (5)$$

where $\hat{B}$ represents an estimate of the power spectrogram of the background (e.g., the repeating portion) of the audio signal and $\lambda$ represents a tolerance factor (which may be adjusted to change how much of the spectrogram is included in the repeating segment model described below).

The time-frequency mask M is then symmetrized and applied to the STFT X of the mixture signal $\chi$. An estimated music signal (e.g., the repeating structure in the mixture signal $\chi$) can be obtained by inverting the resulting STFT into the time domain. The estimated voice signal (e.g., the non-repeating structure in the mixture signal $\chi$) can be obtained by subtracting the time-domain music signal from the mixture signal $\chi$. One example of derivation of the repeating spectrogram model W and the building of the soft time-frequency mask M are illustrated in the third row 104 of FIG. 1. In one embodiment, a binary time-frequency mask M can be derived by forcing time-frequency bins in the mask M with values above a certain threshold $t\in[0,1]$ to a value of 1, while the rest is forced to a value of 0.

Figure 2:
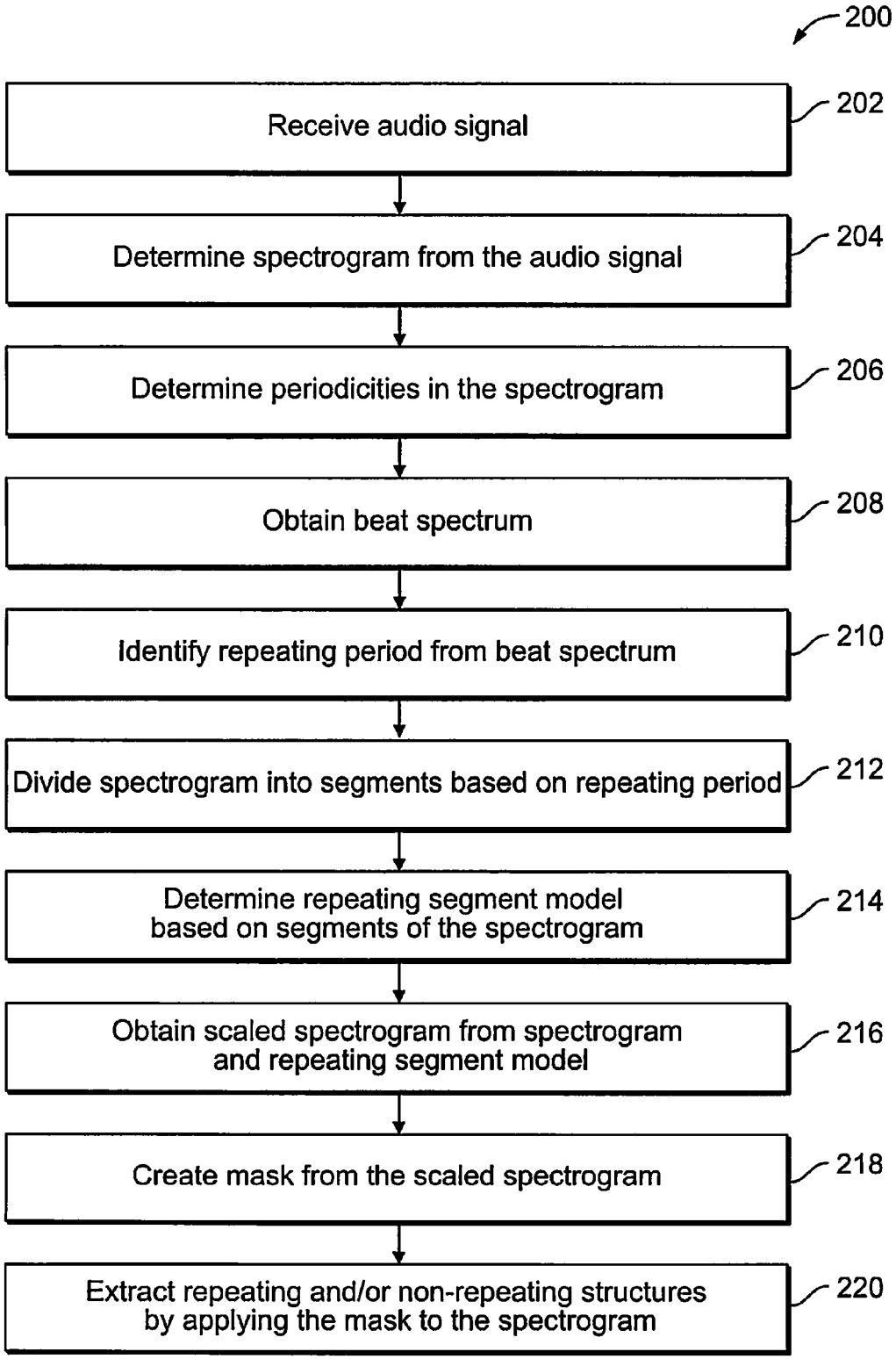
FIG. 2 is a flowchart of one embodiment of a method for separating and/or extracting structures in an audio signal from each other.

FIG. 2 is a flowchart of one embodiment of a method 200 for separating structures in an audio signal from each other. The method 200 may be used to extract and separate repeating structure and non-repeating structure from the audio signal, as described above. The method 200 may be used to implement the REPET algorithm described above in one embodiment.

At 202, an audio signal is received as an input. The audio signal may be a new signal in that the audio signal may not have been previously analyzed to identify one or more characteristics of the audio signal. For example, the system that is using the method 200 (e.g., the system 1700 shown in FIG. 17) may not have previously examined the audio signal to train the system to examine the audio signal for one or more structures or aspects of the audio signal. The audio signal may be representative of sound that is electronically generated (e.g., synthesized), sound that is created by one or more instruments (e.g., string, wind, and/or percussion instruments), vocals (e.g., sounds created by a human being), and/or additional sounds.

Figure 3:
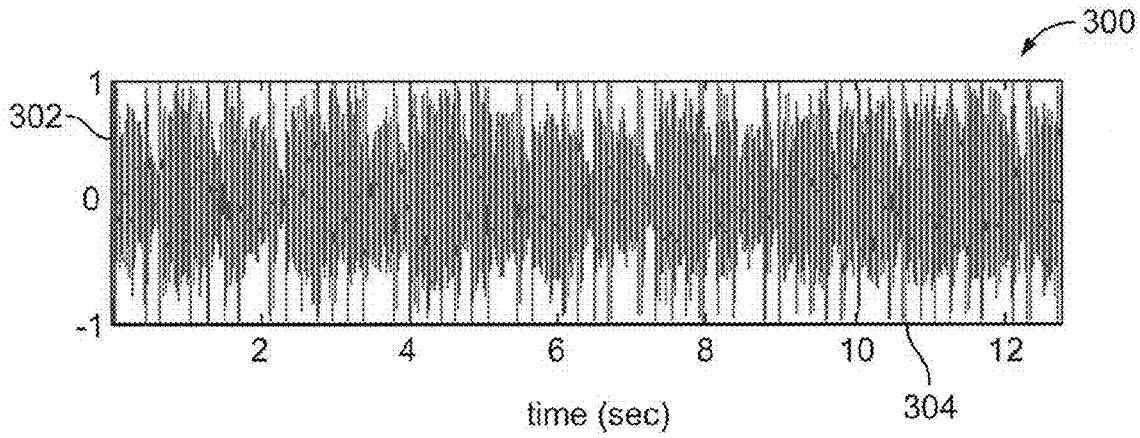
FIG. 3 illustrates one example of an audio signal that may be received.

With continued reference to the method 200 shown in FIG. 2, FIG. 3 illustrates one example of an audio signal 300 that may be received. The audio signal 300 is shown alongside a vertical axis 302 that is representative of decibels of the audio signal 300 and a horizontal axis 304 that is representative of time. The audio signal 300 shown in FIG. 3 is provided merely as one example, and is not intended to be limiting on all embodiments described herein.

At 204 in the method 200, a spectrogram (e.g., V) is determined from the audio signal 300. The spectrogram can be calculated as described above. Alternatively, the power spectrogram (e.g., $V^2$) of the audio signal 300 can be calculated, also as described above.

Figure 4:
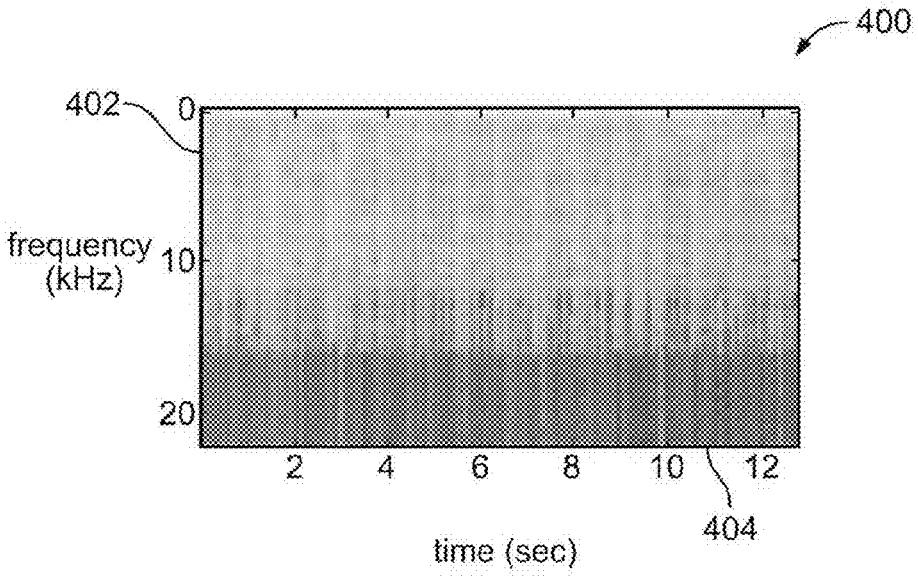
FIG. 4 illustrates one example of a spectrogram that may be created from the audio signal.

With continued reference to the method 200 shown in FIG. 2, FIG. 4 illustrates one example of a spectrogram 400 that may be created from the audio signal 300. The spectrogram 400 is shown alongside a vertical axis 402 that is representative of frequency of the audio signal 300 and a horizontal axis 404 that is representative of time. The spectrogram 400 shown in FIG. 4 is provided merely as one example, and is not intended to be limiting on all embodiments described herein. For example, the spectrogram 400 is shown as a power spectrogram, but alternatively may be another spectrogram (such as a magnitude spectrogram) or another representation of the audio signal 300. References herein to a power spectrogram are not intended to be limiting on all embodiments of the inventive subject matter.

At 206 in the method 200, periodicities in the spectrogram are determined. For example, the period of a repeating structure in the audio signal may be identified. In one embodiment, the periodicities can be identified by generating a correlogram from the spectrogram. The correlogram can be calculated from autocorrelation of rows of the spectrogram, such as at the various frequencies of the correlogram.

Figure 5:
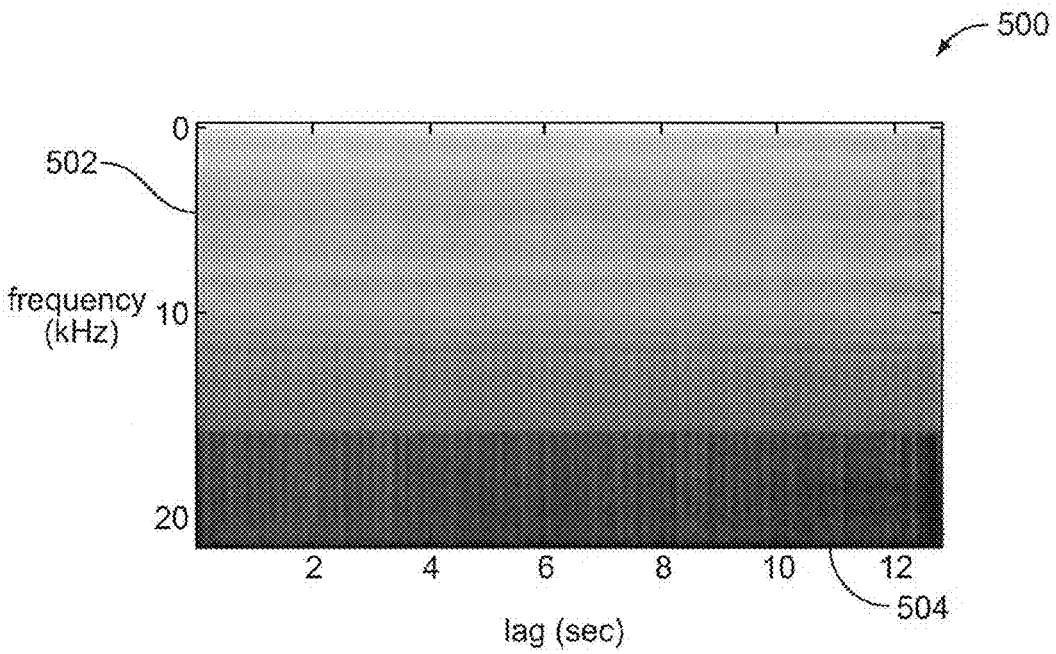
FIG. 5 illustrates one example of a correlogram that may be calculated from the spectrogram.

With continued reference to the method 200 shown in FIG. 2, FIG. 5 illustrates one example of a correlogram 500 that may be calculated from the spectrogram 400. The correlogram 500 is shown alongside a vertical axis 502 that is representative of frequency of the correlogram 500 and a horizontal axis 504 that is representative of time lag. The correlogram 500 shown in FIG. 5 is provided merely as one example, and is not intended to be limiting on all embodiments described herein.

Figure 6:
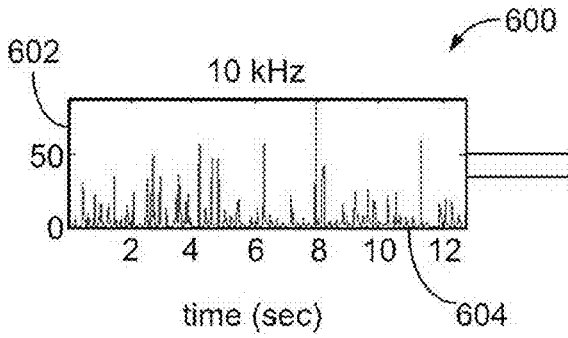
FIG. 6 illustrates one row of the spectrogram.
Figure 7:
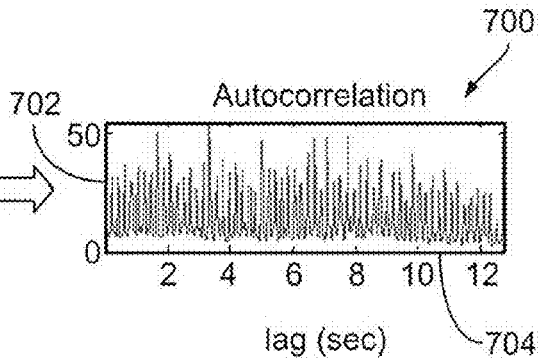
FIG. 7 illustrates a corresponding row of the correlogram.

FIG. 6 illustrates one row 600 (e.g., frequency) of the spectrogram 400 and FIG. 7 illustrates a corresponding row 700 (e.g., the same frequency) of the correlogram 500. The row 600 of the spectrogram 400 is shown alongside a vertical axis 602 that is representative of a power level of the audio signal 300 in the spectrogram 400 at a frequency of 10 kHz, although another frequency may be used. The row 600 also is shown alongside a horizontal axis 604 that is representative of time. The row 700 of the correlogram 500 is shown alongside a vertical axis 702 that is representative of correlation of the spectrogram 400 at the same frequency (e.g., 10 kHz) and a horizontal axis 704 that is representative of time lag. The correlogram 500 shown in FIG. 5 can be created by autocorrelating the various frequencies (e.g., rows) of the spectrogram 400.

Returning to the discussion of the method 200 shown in FIG. 2, at 208, a beat spectrum is obtained from the correlogram. The beat spectrum b can be created by calculating a statistical measure of the rows of the correlogram 500. In one embodiment, the beat spectrum is generated by determining the mean of each, or at least a plurality, of the rows (e.g., the rows 700) of the correlogram 500.

Figure 8:
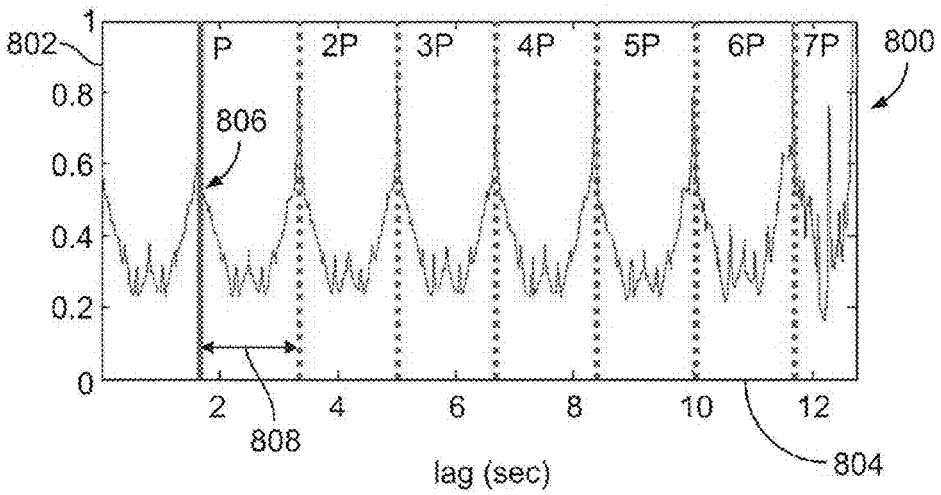
FIG. 8 illustrates one example of a beat spectrum that may be calculated from the correlogram.

With continued reference to the method 200 shown in FIG. 2, FIG. 8 illustrates one example of a beat spectrum 800 that may be calculated from the correlogram 500. The beat spectrum 800 is shown alongside a vertical axis 802 that is representative of average (e.g., mean) correlation and a horizontal axis 804 that is representative of time lag. As described above, the beam spectrum 800 may represent the average of the correlations in the correlogram 500 at each, or at least a plurality of, the frequencies in the correlogram 500. The beat spectrum 800 shown in FIG. 8 is provided merely as one example, and is not intended to be limiting on all embodiments described herein.

Returning to the discussion of the method 200 shown in FIG. 2, at 210, a repeating period of underlying repeating musical structure in the audio signal 300 is identified. The repeating period may be determined by calculating the length of time between successive peaks in the beat spectrum b. For example and with respect to the beat spectrum 800 in FIG. 8, peaks 806 in the beat spectrum 800 may be identified, such as by determining local maxima of the beat spectrum 800. Time periods 808 between the peaks 806 may be calculated. The time periods 808 may vary between different sets of two successive peaks 806. In one embodiment, the mean or median time period may be calculated from the time periods 808 obtained from the beat spectrum 800. This mean or median time period can be designated as the repeating period of the repeating musical structure in the audio signal 300. The repeating period is shown in FIG. 8 by the references P, 2P, 3P, and so on, to indicate the first period, second period, third period, and so on, in the beat spectrum 800.

In one embodiment, a single repeating period may be identified from the beat spectrum 800. For example, and as shown in FIG. 8, the beat spectrum 800 may reveal the same (or approximately the same) repeating time period between successive peaks in the beat spectrum 800. Alternatively, two or more repeating periods may be identified. For example, the beat spectrum 800 may include two or more repeating time periods that occur between different peaks. The beat spectrum 800 can include a first repeating time period between successive occurrences of a first peak in the beat spectrum 800, a second repeating time period between successive occurrences of a second peak in the beat spectrum 800, and so on. The different peaks can be identified based on different shapes of the peaks, different heights of the peaks, and the like. The two or more repeating time periods may at least partially overlap. For example, the beat spectrum may include an alternating sequence of first and second peaks that are separated by corresponding first and second repeating time periods. The second peaks may appear between successive occurrences of the first peaks, and the first peaks may appear between successive occurrences of the second peaks.

Returning to the discussion of the method 200 shown in FIG. 2, at 210, a repeating period of underlying repeating musical structure in the audio signal 300 is identified. The repeating period may be determined by calculating the length of time between successive peaks in the beat spectrum b. For example and with respect to the beat spectrum 800 in FIG. 8, peaks 806 in the beat spectrum 800 may be identified, such as by determining local maxima of the beat spectrum 800. Time periods 808 between the peaks 806 may be calculated. The time periods 808 may vary between different sets of two successive peaks 806. In one embodiment, the mean or median time period may be calculated from the time periods 808 obtained from the beat spectrum 800. This mean or median time period can be designated as the repeating period of the repeating musical structure in the audio signal 300. The repeating period is shown in FIG. 8 by the references P, 2P, 3P, and so on, to indicate the first occurrence of the period, the second occurrence of the period, the third occurrence of the period, and so on, in the beat spectrum 800. As described above, in one embodiment, multiple different repeating time periods may be identified. As a result, as 210, multiple repeating periods of different repeating musical structure in the audio signal 300 can be identified based on the different repeating periods.

At 212, the spectrogram is divided into multiple segments based on the repeating period. For example, the spectrogram 400 can be divided into segments based on the beginning and ending time of each period in the beat spectrum 800. The segments of the spectrogram 400 can then represent portions of the spectrogram 400 having the same temporal durations. As described above, multiple different repeating periods may be identified. As a result, the spectrogram can be divided into different sets of segments based on the different multiple repeating periods. For example, the spectrogram can be divided into a first set of segments based on a first repeating period associated with a first repeating structure in the audio signal 300 and divided into a different, second set of segments based on a different, second repeating period associated with a different, second repeating structure in the same audio signal 300.

Figure 9:
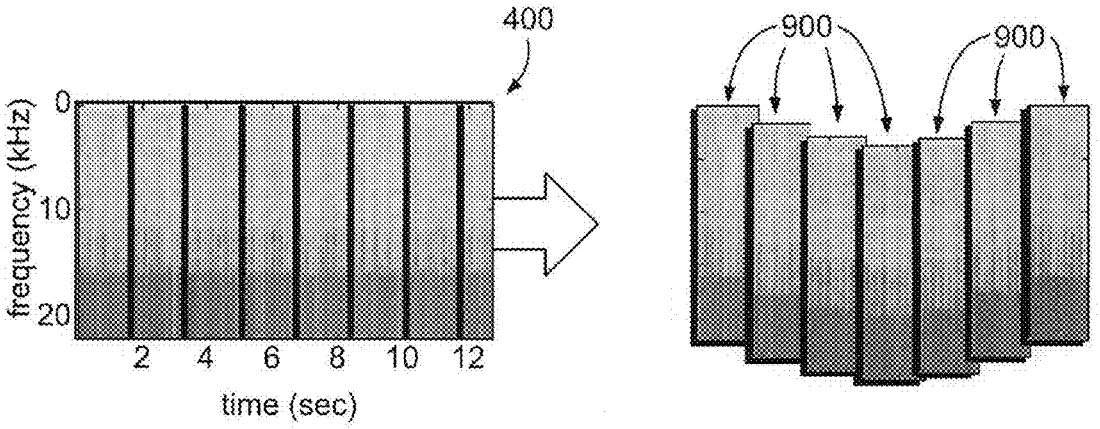
FIG. 9 illustrates one example of segmenting the spectrogram into multiple segments.

With continued reference to the method 200 shown in FIG. 2, FIG. 9 illustrates one example of segmenting the spectrogram 400 into multiple segments 900. As shown in FIG. 9, the spectrogram 400 can be segmented by dividing the spectrogram 400 according to the time period 808 of the beat spectrum 800.

At 214 of the method 200, a repeating segment model is determined based on the segments of the spectrogram. If multiple repeating periods are identified, then multiple respective repeating segment models may be created. The repeating segment model can be obtained by calculating a statistical measure, such as a median, of time-frequency bins of the segments of the spectrogram. A time-frequency bin can represent a range of times and a range of frequencies in the spectrogram and in the segments of the spectrogram. Several time-frequency bins can be identified in this way, such as a first time-frequency bin that extends from 0 to 0.5 seconds and from 0 to 1 kHz, a second time-frequency bin that extends from 0.5 to 1.0 seconds and from 0 to 1 kHz, a third time-frequency bin that extends from 1.0 to 1.5 seconds and from 0 to 1 kHz, a fourth time-frequency bin that extends from 0 to 0.5 seconds and from 1 to 2 kHz, a fifth time-frequency bin that extends from 0.5 to 1.0 seconds and from 1 to 2 kHz, a sixth time-frequency bin that extends from 1.0 to 1.5 seconds and from 1 to 2 kHz, and the like. Alternatively, the bins may extend over different ranges of time and/or frequency. For example, the bins may extend over ranges of 40 milliseconds and 25 Hertz, or over different ranges of time and/or frequency. The values of the segments within each of the bins can then be examined, such as by determining the median of the each bin in the segments. Alternatively, another measure may be performed, such as by calculating a mean of each bin in the segments.

Figure 10:
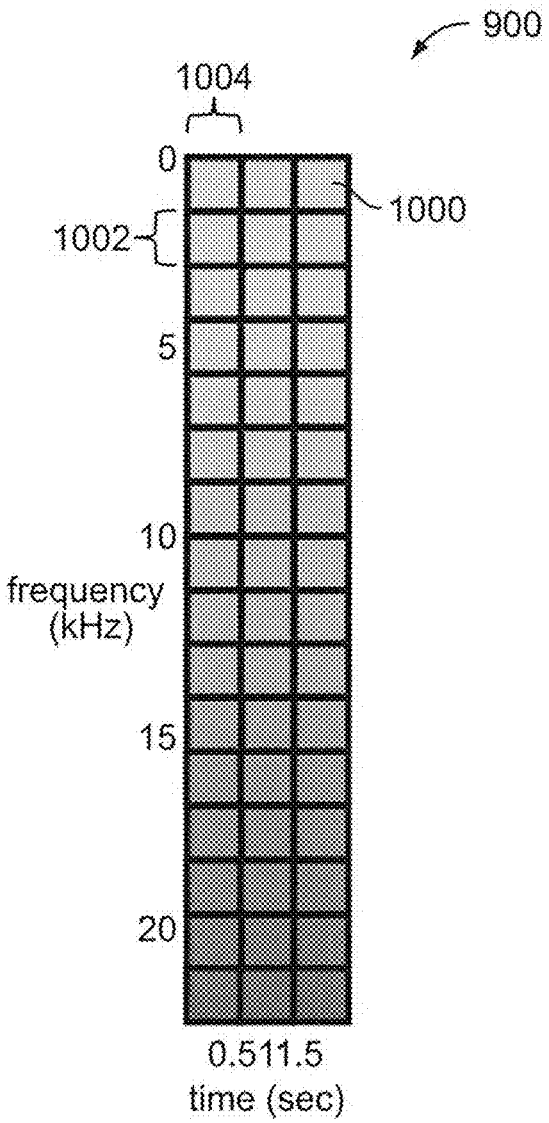
FIG. 10 illustrates one example of identifying bins in one segment of the spectrogram.

With continued reference to the method 200 shown in FIG. 2, FIG. 10 illustrates one example of identifying bins 1000 in one segment 900 of the spectrogram 400. As described above, the bins 1000 can each represent ranges of frequencies and times within the segment 900. In the illustrated example, each bin 1000 represents a different frequency range and/or a different time range such that the bins 1000 form a regular grid across the segment 900. The bins 1000 may have the same frequency range and/or time range. For example, the bins 1000 that are aligned in rows, such as in row 1002, can each extend over different ranges of time, but extend over the same range of frequency. The bins 1000 that are aligned in columns, such as in column 1004, can each extend over different ranges of frequency, but extend over the same range of time.

Characteristics of the bins 1000 may be determined in order to create a repeating segment model. For example, the median of bins 1000 across several segments 900 of the spectrogram 400 can be determined. Alternatively, a mean or other statistical measure of the bins 1000 can be used. The bins 1000 that occur during the same frequency and/or time ranges within each segment 900 can be examined to determine the value of a bin in the corresponding frequency and/or time range in the repeating segment model.

Figure 11:
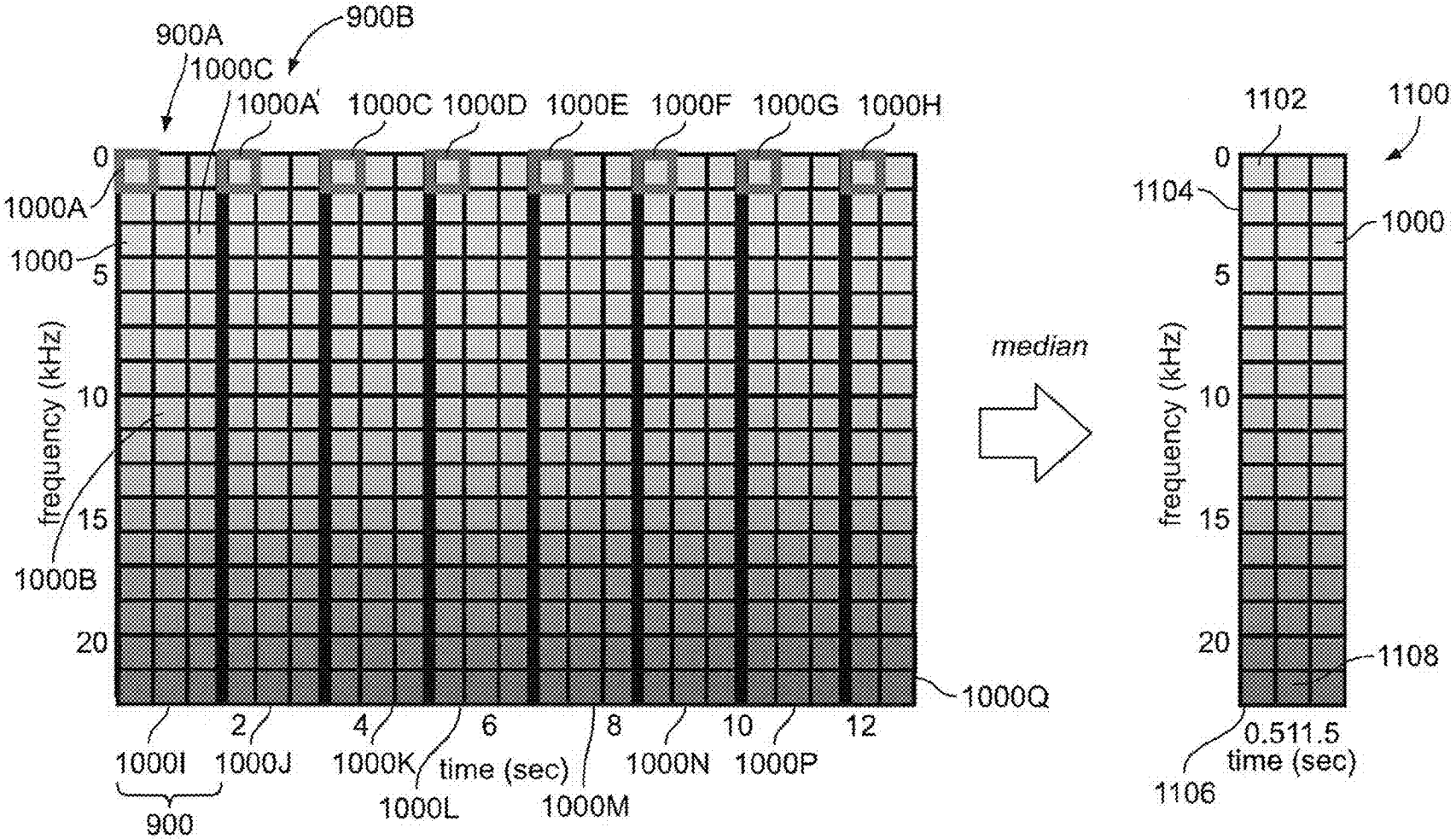
FIG. 11 illustrates one example of determining a repeating segment model.

FIG. 11 illustrates one example of determining a repeating segment model 1100. The segments 900 in the spectrogram 400 may include the bins 1000 that occur over different time and/or frequency ranges. Each segment 900 may have one or more bins 1000 that correspond to the bins 1000 in one or more other segments 900. For example, in a first segment 900A, a first bin 1000A may occur over a first time period of the segment 900A (e.g., from 0 to 0.5 seconds) and over a first frequency range (e.g., 0 to 1 kHz) of the segment 900A, a second bin 1000B may occur over a second time period (e.g., 0.5 seconds to 1.0 seconds) and over a second frequency range (e.g., 10 to 11 kHz) of the segment 900A, a third bin 1000C may occur over a third time period (e.g., 1.0 to 1.5 seconds) and over a third frequency range (e.g., 2 to 3 kHz), and the like. As described above, the bins may extend over different ranges of time and/or frequency. For example, the bins may extend over ranges of 40 milliseconds and 25 Hertz, or over different ranges of time and/or frequency. Although only three bins 1000 are identified in the first segment 900A, several additional bins 1000 also may be identified. Corresponding bins 1000 may be identified in other segments 900. For example, a first bin 1000A' in a second segment 900B may correspond to the first bin 1000A of the first segment 900A in that the bins 1000A, 1000A' occur over the same relative time ranges and relative frequency ranges within each segment 900. Additional corresponding bins 1000 may be identified in the several segments of the spectrogram 400.

A repeating segment model can be created by determining characteristics of the bins 1000 that correspond to each other among the segments 900 in the spectrogram 400. For example, a median of the bins 1000 that correspond with each other in the segments 900 of the spectrogram 400 can be calculated for each (or at least a plurality) of the bins 1000 in the spectrogram 400. Alternatively, a mean or other measure of the bins 1000 may be used. The repeating segment model can include the characteristics of the bins 1000 at the times and frequencies that correspond to the bins 1000 from which the characteristics are determined.

FIG. 11 illustrates one example of the repeating segment model 1100. The repeating segment model 1100 can be created based on the characteristics of the bins 1000 shown in FIG. 10, with each median being shown in the time and frequency range that corresponds to the bins 1000 from which the characteristic was calculated. The model 1100 is shown alongside a vertical axis 1104 that is representative of frequency and a horizontal axis 1106 that is representative of time. In the illustrated embodiment, the model 1100 represents the medians of the corresponding bins 1000 that occur at the same relative time and frequencies within the different segments 900. A first bin 1102 in the model 1100 may represent the median of bins 1000A, 1000A', 1000C-H, a second bin 1108 in the model 1100 may represent the median of the bins 1000I-N, 1000P-Q, and the like. The model 1100 shown in FIG. 11 is provided only as an example and is not intended to be limiting on all embodiments described herein.

Returning to the discussion of the method 200 shown in FIG. 2, at 216, a scaled spectrogram of the audio signal 300 is obtained from the spectrogram 400 and the repeating segment model 1100. If multiple models are created based on multiple repeating periods in the spectrogram (as described above), then multiple scaled spectrograms can be created at 216.

In one embodiment, the scaled spectrogram is created by dividing the segments 900 in the spectrogram 400 by the repeating segment model 1100. The segments 900 may be divided by the model 1100 to determine where (e.g., in the frequency domain and time domain) the spectrogram 400 has values that are the same as or approximately the same as (e.g., within a designated tolerance threshold or the tolerance t) the model 1100. For example, if a time-frequency bin in a segment 900 of the spectrogram 400 and a corresponding time-frequency bin in the model 1100 have the same value or approximately same value, then dividing the bin in the spectrogram 400 by the corresponding bin in the model 1100 yields a value of one or a value that is relatively close to one. On the other hand, if a bin in the segment 900 of the spectrogram 400 and a corresponding bin in the model 1100 have different values, then dividing the bin in the segment 900 of the spectrogram 400 by the corresponding bin in the model 1100 yields a value that is not one and/or that is not relatively close to one.

Figure 12:
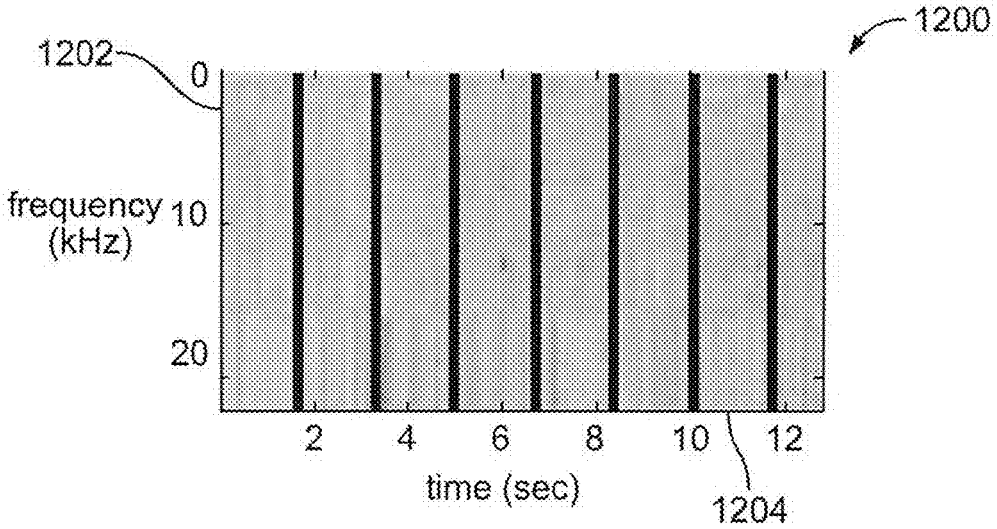
FIG. 12 illustrates one example of a scaled spectrogram that is based on the audio signal shown in FIG. 3.

FIG. 12 illustrates one example of a scaled spectrogram 1200 that is based on the audio signal 300 shown in FIG. 3. The scaled spectrogram 1200 can be created by dividing the segments 900 of the spectrogram 400 by the repeating segment model 1100, as described above. The scaled spectrogram 1200 is shown alongside a vertical axis 1202 that represents frequency and a horizontal axis 1204 that represents time. As described below, the scaled spectrogram 1200 can be used to create a mask that is then used to extract repeating structure in the audio signal 300. The scaled spectrogram 1200 is provided only as an example and is not intended to be limiting on all embodiments described herein.

Returning to the discussion of the method 200 shown in FIG. 2, at 218, a mask is created from the scaled spectrogram 1200. If multiple repeating periods are identified (as described above), then multiple masks can be created from the multiple scaled spectrograms 1000. The mask may be a binary mask that includes one of two values in each time-frequency bin of the scaled spectrogram 1200. In one embodiment, the mask includes a value of one in the time-frequency bins that have values in the scaled spectrogram 1200 that are one or relatively close to one. For example, if a first time-frequency bin in the model 1100 has a median value and the same first time-frequency bin in the scaled spectrogram 1200 has a value of one or a value that is within a designated tolerance threshold of one (e.g., the tolerance t or a value that is based on the tolerance t), then the mask may be assigned a value of one in that time-frequency bin. Otherwise, the mask may be assigned a value of zero (or another value other than one) in the time-frequency bin. This assignment of values can be performed across all or at least a plurality of the time-frequency bins of the scaled spectrogram 1000 to form the mask.

Alternatively, instead of creating the scaled spectrogram 1200 and then generating the mask based on the scaled spectrogram 1200, the mask may be created based on a comparison of the spectrogram 400 and the repeating segment model 1100. For example, for time-frequency bins in the spectrogram 400 having values that are the same as or within a designated tolerance threshold as the model 1100, the mask may be assigned a value of one (or another value) at the same time-frequency bin in the mask. Otherwise, the time-frequency bin in the mask may be assigned a value of zero (or another value).

In another embodiment, the mask may be a tertiary or other mask that has one of three or more values in each time-frequency bin of the scaled spectrogram 1200. For example, instead of the time-frequency bins having a value of one or zero based on whether the scaled spectrogram 1200 has a value at or near one, or another value, the time-frequency bins may be assigned one of three or more values based on the value of the corresponding time-frequency bin of the scaled spectrogram 1200. The different values may be assigned based on how similar or how different the values of the bins in the spectrogram 400 are from the repeating segment model 1100. For example, for no or relatively small differences, the time-frequency bins may have a first value; for larger differences, the bins may have a different, second value; for even larger differences, the bins may have a different, third value; and the like.

Figure 13:
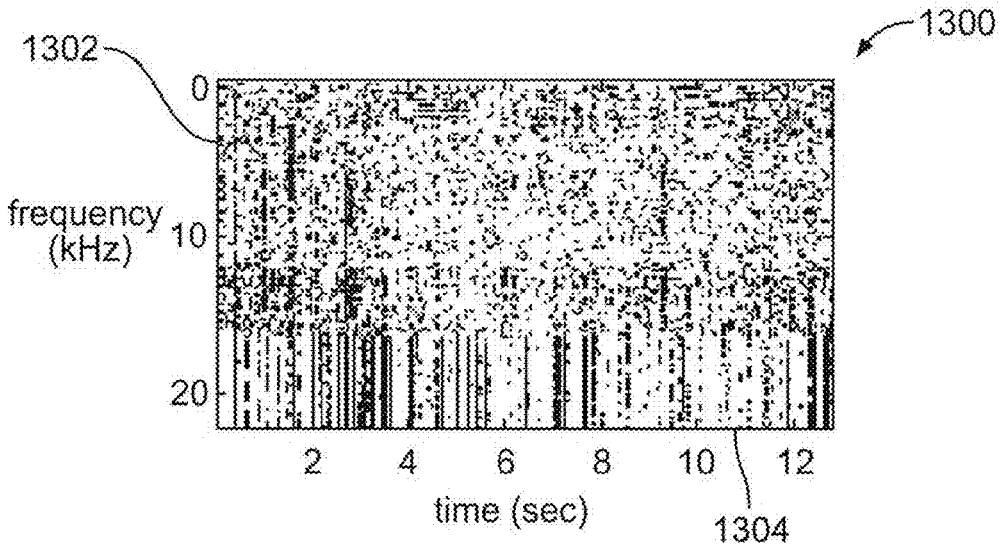
FIG. 13 illustrates one example of a mask that is based on the similarities or differences between the spectrogram and the repeating segment model.

FIG. 13 illustrates one example of a mask 1300 that is based on the similarities or differences between the spectrogram 400 and the repeating segment model 1100. The mask 1300 is shown alongside a vertical axis 1302 that represents frequency and a horizontal axis 1304 that represents time. The mask 1300 can be created by assigning values to time-frequency bins of the mask, as described above. The mask 1300 shown in FIG. 13 is provided only as an example and is not intended to be limiting on all embodiments described herein.

In another embodiment, the mask may be a soft-time frequency mask M that is created by normalizing a spectrogram W of the audio signal (e.g., a non-negative repeating spectrogram W of the audio signal) by a magnitude spectrogram V of the audio signal, element wise (e.g., normalizing corresponding time-frequency bins of the spectrograms W V). The time-frequency bins that are likely to repeat at the period p in the magnitude spectrogram V may have values that are at or near 1 in the soft time-frequency mask M and can be weighted toward the repeating background of the audio signal. The time-frequency bins that are not likely to repeat or are less likely to repeat at the period p in the magnitude spectrogram V may have values at or near 0 in the soft time-frequency mask M and may be weighted toward the non-repeating foreground of the audio signal. One example of calculation of the soft time-frequency mask M is shown above in Equation 4. Another example of calculation of the mask M is shown above in Equation 5.

Alternatively, the mask may be derived as a binary time-frequency mask by forcing time-frequency bins in the mask M with values above a certain threshold t (e.g., $t \in [0,1]$) to 1, while the rest of the bins have values that are forced to 0.

Returning to the discussion of the method 200 shown in FIG. 2, at 220, one or more spectrograms that represent one or more components of the audio signal 300 are extracted from the audio signal 300 using the mask 1300. For example, a spectrogram of the repeating structure in the audio signal 300 may be extracted. The spectrogram of the structure that is extracted may be referred to as an extracted spectrogram. If multiple masks are created based on multiple different periods being identified in the beat spectrum (as described above), then these multiple masks can be used to extract different spectrograms associated with the respective different periods.

Figure 14:
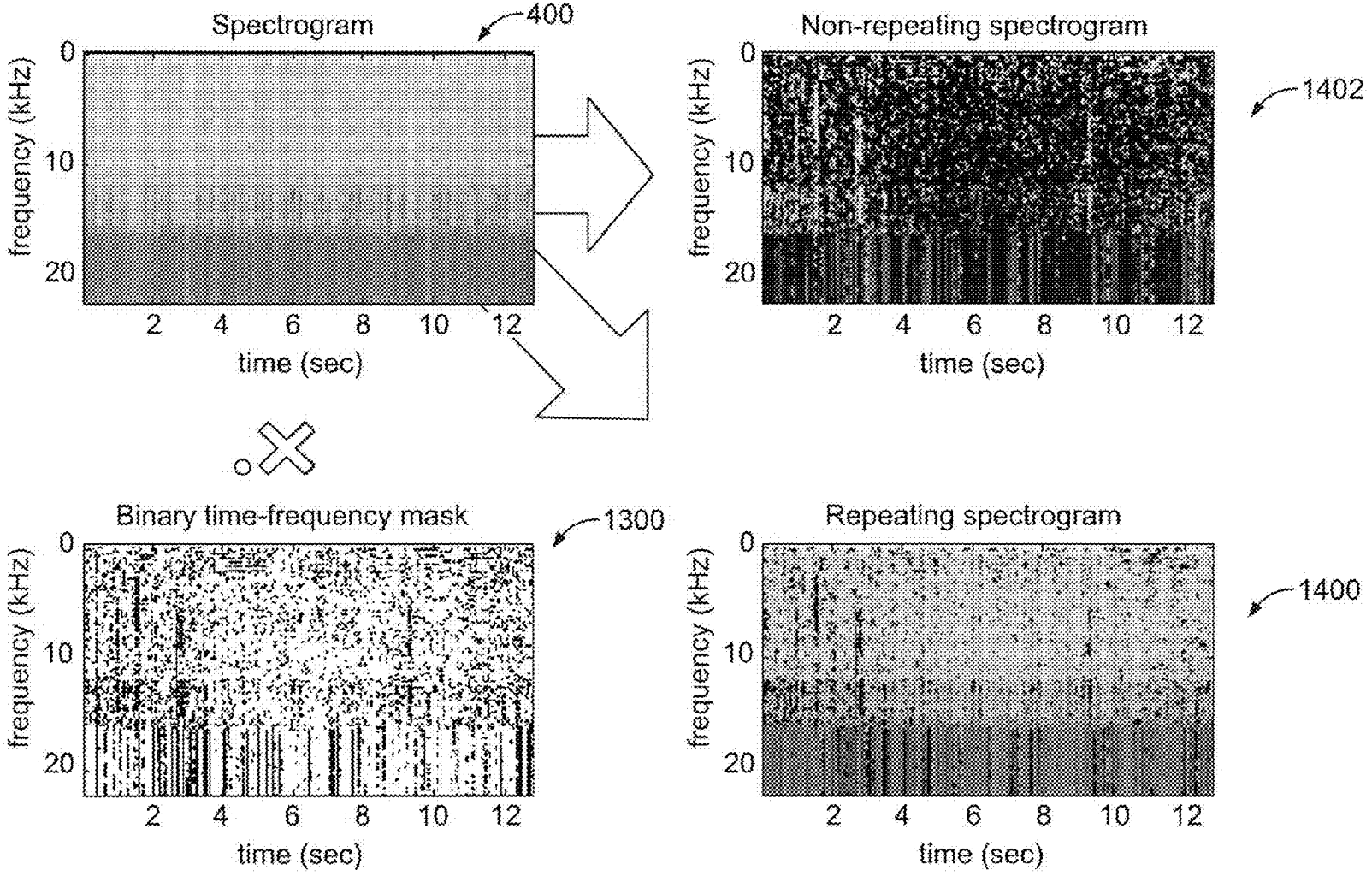
FIG. 14 illustrates one example of extraction of a repeating spectrogram and a non-repeating spectrogram from the spectrogram using the mask.

FIG. 14 illustrates one example of extraction of a repeating spectrogram 1400 and a non-repeating spectrogram 1402 from the spectrogram 400 using the mask 1300. In one embodiment, the extracted spectrograms 1400, 1402 are obtained by comparing the mask 1300 to the spectrogram 400 and including the values in the time-frequency bins of the spectrogram 400 that match or correspond to a first value of the time-frequency bins in the mask 1300 in the extracted spectrogram 1400 but not the other extracted spectrogram 1402, and including the values in the bins of the spectrogram 400 that match or correspond to another value of the bins in the mask 1300 in the extracted spectrogram 1202 but not the extracted spectrogram 1200.

For example, the bins in the spectrogram 400 that correspond to the bins in the mask 1300 having a value of one are included in the repeating extracted spectrogram 1400 while other bins from the spectrogram 400 are not included in the repeating extracted spectrogram 1400. These excluded bins may be included in the non-repeating extracted spectrogram 1402. In one example, the repeating extracted spectrogram 1400 may be obtained by multiplying the mask 1300 (that is a binary mask having bins with values of zero or one, as described above) by the spectrogram 400 or by the STFT of the audio signal. After multiplication, the resulting spectrogram is the repeating extracted spectrogram 1400 that represents the portions of the audio signal 300 that are the repeating structure of the audio signal 300. The remaining portion of the spectrogram 400 (e.g., the portion that was multiplied by the zeros in the bins of the mask 1300) is the non-repeating extracted spectrogram 1402 that represents the portions of the audio signal 300 that are not the repeating structure of the audio signal 300.

Alternatively or additionally, the bins in the spectrogram 400 may be included in different extracted spectrograms based on the values in the corresponding bins of the mask 1300. For example, those bins in the spectrogram 400 that correspond with the bins having a first value in the mask 1300 are included in a first extracted spectrogram, the bins in the spectrogram 400 that correspond with the bins having a second value in the mask 1300 are included in a second extracted spectrogram, and so on. In a mask 1300 having three or more possible values in the bins, a corresponding three or more extracted spectrograms may be obtained.

Returning to the discussion of the method 200 shown in FIG. 2, at 220, one or more reconstructed audio signals are generated from one or more of the extracted spectrograms. The one or more extracted spectrograms may be individually converted into separate audio signals. The resulting audio signal or signals may audibly represent the different structures in the original audio signal 300. For example, the repeating extracted spectrogram may be converted into a first audio signal that represents the repeating structure in the audio signal 300. In one embodiment, the non-repeating extracted spectrogram may be converted into a second audio signal that represents the non-repeating structure in the audio signal 300.

Figure 15:
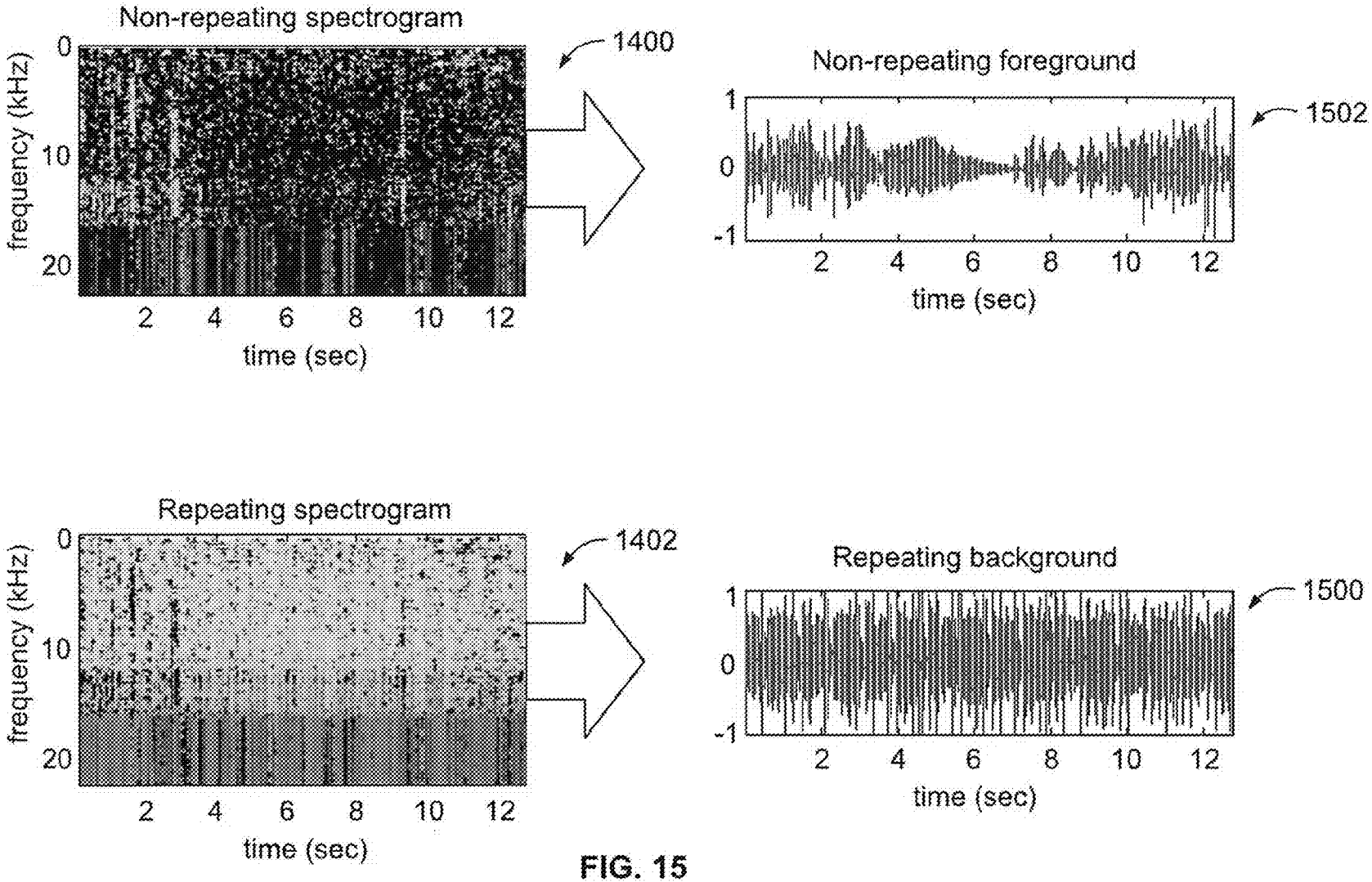
FIG. 15 illustrates examples of a repeating structure audio signal and a non-repeating structure audio signal.

FIG. 15 illustrates examples of a repeating structure audio signal 1500 and a non-repeating structure audio signal 1502. The repeating structure audio signal 1500 represents the portions of the audio signal 300 that are repeated on a periodic or semi-regular basis (e.g., a structure that is repeated but that may shift in time over the duration of the audio signal 300), while the non-repeating structure audio signal 1502 represents the portions of the audio signal 300 that are not repeated on a periodic or semi-regular basis. The repeating structure audio signal 1500 may be formed by converting the repeating extracted spectrogram 1400 into a first audio signal that can be played (e.g., used to create audible sounds for listening by one or more operators). The non-repeating structure audio signal 1502 can be formed by converting the non-repeating extracted spectrogram 1402 into a different, second audio signal that can be played.

Additionally or alternatively, the method 200 can be separately performed for different temporal segments of the audio signal 300. For example, the audio signal 300 may include different structures (repeating and/or non-repeating) at different times of the audio signal 300. The method 200 can be separately performed for each (or at least one) of these times in order to extract the repeating and/or non-repeating structure associated with the times. For example, the audio signal 300 may include a first repeating structure and a first non-repeating structure during a first temporal section of the audio signal 300 (e.g., the first thirty seconds of the audio signal 300), a second repeating structure and a second non-repeating structure during a subsequent, second temporal section of the audio signal 300 (e.g., the next 240 seconds of the audio signal 300), and a third repeating structure and a third non-repeating structure during a subsequent, third temporal section of the audio signal 300 (e.g., the last twenty seconds of the audio signal 300). The method 200 may be performed for the first temporal section to extract the first repeating structure and/or the first non-repeating structure, for the second temporal section to extract the second repeating structure and/or the second non-repeating structure, and/or for the third temporal section to extract the third repeating structure and/or the third non-repeating structure.

In one embodiment, the extracted spectrograms and/or extracted audio signals may be post-processed, such as by using a high-pass filtering (e.g., a filtering of 100 Hz on a non-repeating structure of the audio signal). This can be done automatically without any additional information. A repeating period can be manually selected so that the selected period provides an improved mean signal to distortion ratio (SDR) between the repeating and non-repeating extracted spectrograms and/or audio signals.

The method 200 also or alternatively may be used as a preprocessor for pitch detection algorithms to improve melody extraction from the audio signal that is used as an input. For example, the method 200 can be used to separate the repeating structure in an audio signal from the non-repeating structure. A pitch detection algorithm can then be applied to the non-repeating structure to extract the pitch contour.

In addition or as an alternate to extracting repeating and/or non-repeating structure from the audio signal 300 based on a periodically repeating structure in the audio signal 300, a variation of one or more embodiments described herein may be used to extract a repeating structure in the audio signal 300 that is not a regularly occurring or periodic structure. For example, structures in the audio signal 300 that repeat intermittently or without a fixed period may be identified and extracted. The audio signals 300 can therefore be processed with fast-varying repeating structures and/or isolated repeating elements. In one embodiment, instead of looking for periodicities in the audio signal 300, a similarity matrix can be used to identify the repeating elements in the audio signal 300. A repeating spectrogram model can be calculated using a median and the repeating patterns can be extracted using time-frequency masking.

A similarity matrix includes a two-dimensional representation having data points (a, b) that represent the similarity or dissimilarity between any two elements a and b of a given sequence or input, such as the audio signal 300. A similarity matrix can be calculated from the audio signal 300 in order to reveal the repeating structure (e.g., the patterns or portions of the audio signal 300 that repeat one or more times) in the audio signal 300. The similarity matrix can assist in visualizing the repeating (e.g., similar) patterns in the audio signal. For example, the similarity matrix of a mixture of repeating music and non-repeating voice can represent the structure of the music component that is repeated one or more times. The remaining portions that are shown in the similarity matrix may be more likely to be the non-repeating voice components within the repeating musical component. The repeating patterns may be patterns that repeat, but not in a periodic manner (e.g., the patterns repeat in a non-periodical manner).

In one embodiment, a Short-Time Fourier Transform (STFT) X can be determined for a mixture signal $\chi$ (such as a single channel audio signal) using half-overlapping Hamming windows of N samples length. A magnitude spectrogram V can be derived by taking the absolute value of the elements of the STFT X, after discarding the symmetric part, while keeping the DC component. A similarity matrix S may be defined as the matrix multiplication between the transposed spectrogram V and the spectrogram V after normalization of the columns (e.g., times) of the spectrogram V by the Euclidean norm of the columns. For example, each point or frame $(j_a, j_b)$ in the similarity matrix S may represent a cosine similarity between the time frames $j_a$ and $j_b$ of the mixture spectrogram V. One example calculation of the similarity matrix S may be performed using Equation 6.

$$S(j_a, j_b) = \frac{\sum_{i=1}^{n} V(i, j_a)V(i, j_b)}{\sqrt{\sum_{i=1}^{n} V(i, j_a)^2}\sqrt{\sum_{i=1}^{n} V(i, j_b)^2}} \tag{6}$$

where $n = N/2 + 1 = \#$ frequency channels $\forall\, j_a, j_b \in [1, m]$ where $m = \#$ time frames Alternatively, the similarity matrix S can be determined using distance between frames based on any standard distance measure. One example is the P-norm and variants thereof, including but not limited to Manhattan Distance, Euclidean Distance and squared Euclidean distance. Other examples include cosine similarity and Kullback-Leibler divergence.

The similarity matrix S can be used to identify repeating elements in the mixture spectrogram V. For the frames j in the mixture spectrogram V, the frames that are the most similar or more similar (e.g., relative to one or more other frames) to a given or designated frame j are identified and saved in a vector of indices Jj. If non-repeating structure (e.g., the foreground or voice portion of the audio signal 300) is sparse and/or varied compared to the repeating structure (e.g., the background or non-vocal music portion of the audio signal 300), then the repeating elements revealed by the similarity matrix S may be identified as those elements that form the underlying repeating structure. The use of a similarity matrix S allows for the identification of repeating elements that do not necessarily happen in a periodic fashion. For example, the similarity matrix S can be used to identify structure in the audio signal 300 that repeats, but not on in a regular or precisely periodic manner.

To limit the number of repeating frames that are considered similar to the designated frame j, a designated (e.g., maximum or other number) allowed number of repeating frames is identified as k. A designated (e.g., minimum or other number) threshold is represented as t, which is the allowed threshold for the similarity between a repeating frame and the designated frame ($t \in [0,1]$). Consecutive frames can exhibit high similarity without representing new instances of the same structural element, since frame duration may be unrelated to the duration of musical elements in the audio signal 300. As a result, a designated (e.g., minimum or other number) allowed (time) distance between two consecutive repeating frames deemed to be similar enough to indicate a repeating element can be identified as d.

Once the repeating elements have been identified for the frames j in the mixture spectrogram V through corresponding vectors of indices Jj, the repeating elements are used to derive a repeating spectrogram model W for the background structure in the audio signal 300. For the frames j in the mixture spectrogram V, a corresponding frame j in the model W is derived by taking the median of the corresponding repeating frames whose indices are given by vector Jj, for every or one or more frequency channels. One example of a calculation of the repeating spectrogram model W is shown in Equation 7.

$$W(i, j) = \underset{l \in [1,k]}{\text{median}}\{V(i, J_j(l)\} \tag{7}$$

where $J_i = [j_1 \ \ldots \ j_k]$ = indices of repeating frames where $k$ = maximum number of repeating frames $\forall\, i \in [1, n]$ = frequency channel index $\forall\, j \in [1, m]$ = time frame index If the non-repeating structure (e.g., the foreground or vocal portion) has a sparse time-frequency representation compared to the time-frequency representation of the repeating structure (e.g., the background or non-vocal portion), time-frequency bins with relatively little deviations between repeating frames can be a repeating pattern and can be captured by the median. Accordingly, time-frequency bins with large deviations between repeating frames can represent a non-repeating pattern and may be removed by the median. One example of the derivation of the repeating spectrogram model W from the mixture spectrogram V using the similarity matrix S is illustrated in FIG. 16.

Figure 16:
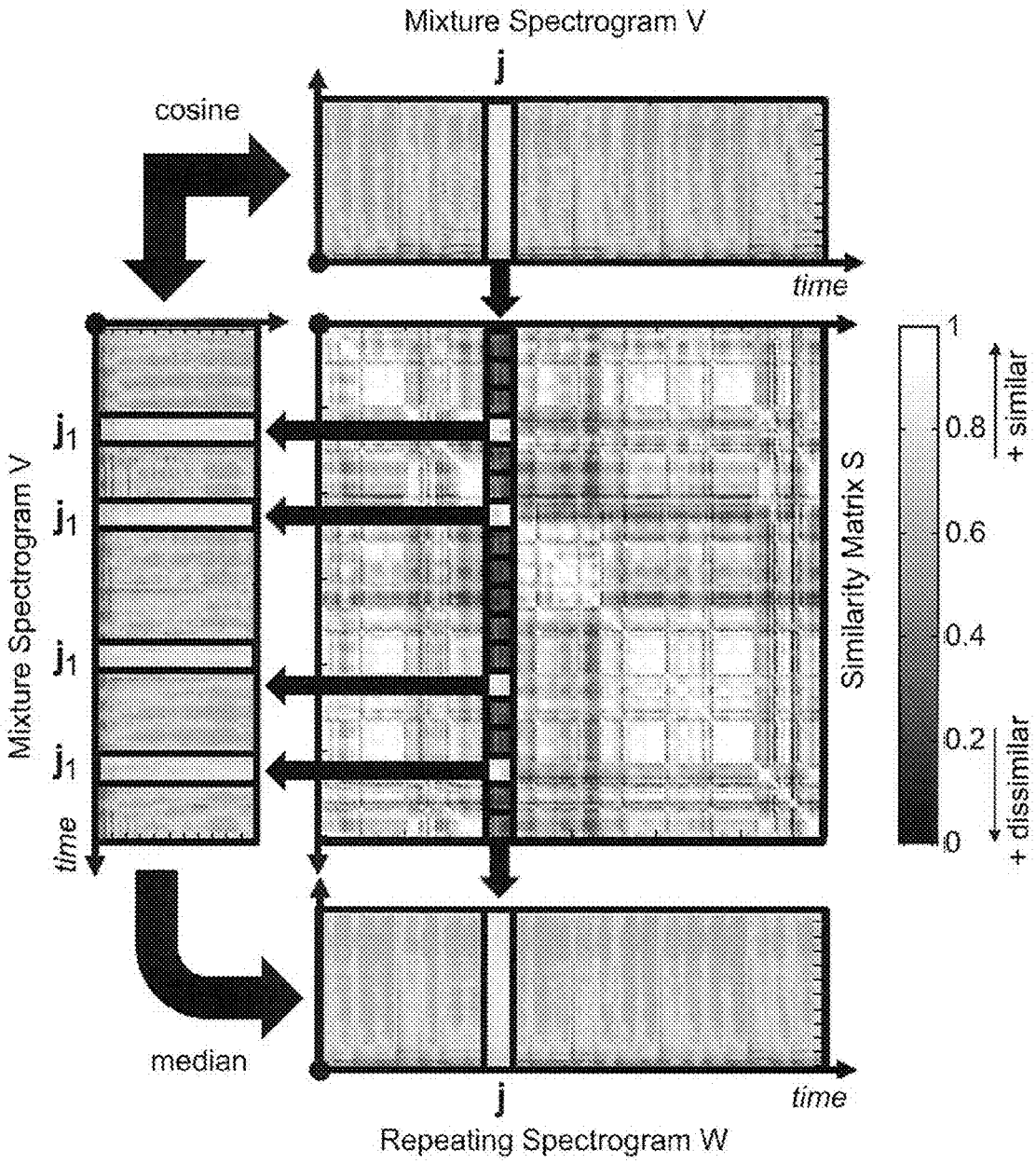
FIG. 16 illustrates one embodiment of a derivation of a repeating spectrogram model.

FIG. 16 illustrates one embodiment of a derivation of a repeating spectrogram model W. In the illustrated embodiment, the similarity matrix S is computed from the mixture spectrogram V using the cosine similarity measure. For the frames j in the mixture spectrogram V, the k frames $j_1 \ldots j_k$ that are similar to the frame j (e.g., the most similar or more similar than a designated fraction or percentage of the frames) are identified using the similarity matrix S. The frame j of the repeating spectrogram model W is derived by taking the median of the k frames $j_1 \ldots j_k$ of the mixture spectrogram V, for every frequency channel in one embodiment.

The repeating spectrogram model W can be used it to derive a time-frequency mask M. A refined repeating spectrogram model W' for the repeating structure, by taking the minimum between the model W and the mixture spectrogram V for every time-frequency bin or at least a plurality of the time-frequency bins. If the non-negative mixture spectrogram V is the sum of a non-negative repeating spectrogram model W and a non-negative non-repeating spectrogram V-W, then time-frequency bins in the model W may have, at most, the same value as the corresponding time-frequency bins in the mixture spectrogram V. For example, the model W may be less than or equal to the mixture spectrogram V for every time-frequency bin (or at least a designated amount of fraction of the time-frequency bins).

A time-frequency mask M can be derived by normalizing the refined model W' by the mixture spectrogram V, for every time-frequency bin (or at least a designated amount of fraction of the time-frequency bins). The time-frequency bins that are likely to constitute a repeating pattern in the mixture spectrogram V may have values near 1 in the model M and may be weighted toward the repeating structure. The time-frequency bins that are unlikely to constitute a repeating pattern in the mixture spectrogram V may have values near 0 in the model M and may be weighted toward the non-repeating structure. One example of the calculation of the time-frequency mask M is shown in Equation 8.

$$W'(i, j) = \min(W(i, j), V(i, j)) \tag{8}$$

$$M(i, j) = \frac{W'(i, j)}{V(i, j)} \text{ with } M(i, j) \in [0, 1]$$

$\forall\, i \in [1, n]$ = frequency channel index $\forall\, j \in [1, m]$ = time frame index Alternatively, the mask M may be obtained using Equation 5, described above. The time-frequency mask M is then symmetrized and applied to the STFT X of the mixture signal $\chi$. An estimated signal that represents the repeating structure is obtained by inverting the resulting STFT into the time domain. The estimated non-repeating structure can be obtained by subtracting or removing the repeating structure from the mixture signal $\chi$.

Figure 17:
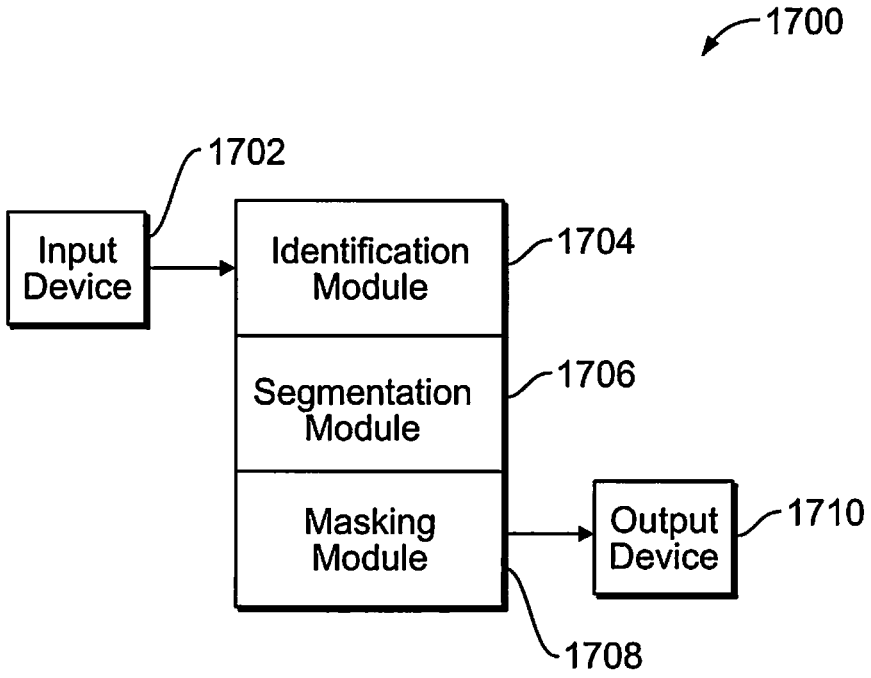
FIG. 17 is a schematic diagram of one embodiment of an audio separation system.

FIG. 17 is a schematic diagram of one embodiment of an audio extraction system 1700. The system 1700 may be used in accordance with one or more embodiments described herein, such as in connection with automatically separating and extracting repeating and non-repeating structures from the same audio signal. The system 1700 may be used to identify and/or extract repeating structure that is repeated in a regular (e.g., periodic) manner and/or repeating structure that is repeated in a non-regular (e.g., not periodic) manner. For example, the system 1700 can be used to implement one or more embodiments of the methods described above.

The system 1700 includes an input 1702, such as a device or module that receives input data, such as an audio recording including two or more sounds that may be separated from each other into separate components or audio signals, such as separate music and voice signals. As used herein, the term "module" may include hardware (e.g., circuitry, controllers, processors, and the like) and/or software (e.g., one or more sets of instructions stored on a tangible and non-transitory computer readable storage medium such as a computer accessible memory) that perform one or more operations. For example, the input 1702 may represent hardware and/or software that receive an audio signal or spectrogram for analysis and separation into separate audio signals and/or components, such as a microphone or other input device. Although several modules are shown and described, these modules may be contained on a single hardware component or divided up among several hardware components. In one embodiment, one or more of the modules shown in FIG. 17 can represent a tangible and computer-readable storage medium (e.g., a computer hard drive or other memory) that has one or more sets of instructions. These sets of instructions can direct hardware (e.g., a processor of a computer) to perform various functions, such as the operations described herein.

In one embodiment, the system 1700 also includes an identification module 1704 that determines a period of repeating segments in the audio signal or spectrogram received by the input 1702, as described above. The identification module 1704 may calculate the beat spectrum described above and may look for repeating peaks in a spectrogram of the audio signal that reveal the repeating structure of the audio signal, also as described above. Alternatively or additionally, the identification module 1704 may determine a similarity matrix of the audio signal and identify the repeating structure in the audio signal from the similarity matrix, as described above.

The system 1700 may include a segmentation module 1706 that segments the spectrogram of the recording into segments of the period determined by the identification module 1704. The segmentation module 1706 may separate the spectrogram into the repeating structures based on the length of the period. In one embodiment, the segmentation module 1706 calculates the mean, median, mode, or other statistical measure of the segments. Alternatively, if the identification module 1704 is used to determine a similarity matrix, then the segmentation module 1706 may not be used. For example, the segmentation module 1706.

The system 1706 includes a masking module 1708 that divides time-frequency bins in each of the repeating segments by the corresponding bin in the calculated mean, median, mode, or other statistical measure of the segments (as calculated by the segmentation module 1706). The masking module 1708 may create a modified spectrogram and determine a time-frequency mask based on the modified spectrogram, as described above. The masking module 1708 may then apply the mask to the spectrogram to separate the components (e.g., music and vocals) from the spectrogram, also as described above.

The masking module 1708 may output one or more of the separated components to an output 1710 of the system 1700. For example, the masking module 1708 can output extracted repeating spectrograms or audio signals. The output 1710 can include a device and/or module that provide one or more of the components to an operator of the system 1700. For example, the output 1710 can include speakers for audibly presenting one or more of the separated components, a display that visually presents (e.g., by electronically displaying a spectrogram) of one or more of the separated components, and/or a printer that outputs one or more of the separated components (e.g., by printing a spectrogram).

In accordance with one embodiment, a system is provided that is configured to separate first and second components of an audio recording from each other by identifying a repeating structure in the audio recording, segmenting the audio recording into segments based on the repeating structure, generating a repeating segment model based on the segments of the audio recording, and identifying at least one of the first component or the second component of the audio recording by comparing the audio recording to the repeating segment model.

In another aspect, the first component and the second component of the audio recording include vocals and music, respectively, of the audio recording.

In another aspect, the system is configured to identify the repeating structure by calculating a period of the repeating structure in the audio recording.

In another aspect, the system is configured to segment the audio recording into the segments based on the period that is identified.

In another aspect, the system is configured to generate the repeating segment model by calculating at least one of a mean, median, or mode of one or more of the segments of the audio recording.

In another aspect, the system is configured to identify at least one of the first component or the second component of the audio recording by generating a mask representative of the repeating structure in the audio recording and comparing the mask to the audio recording.

In another aspect, the system is configured to extract at least one of the first component or the second component of the audio recording by at least one of separating the first component from the audio recording as portions of the audio recording that do not match the mask or separating the second component from the audio recording as portions of the audio recording that match the mask.

In another embodiment, a method is provided that includes identifying a repeating structure in the audio recording, segmenting the audio recording into segments based on the repeating structure, generating a repeating segment model based on the segments of the audio recording, and identifying at least one of the first component or the second component of the audio recording by comparing the audio recording to the repeating segment model.

In another aspect, the first component and the second component of the audio recording include vocals and music, respectively, of the audio recording.

In another aspect, identifying the repeating structure includes calculating a period of the repeating structure in the audio recording.

In another aspect, the method also includes segmenting the audio recording into the segments based on the period that is identified.

In another aspect, generating the repeating segment model includes calculating at least one of a mean, median, or mode of one or more of the segments of the audio recording.

In another aspect, identifying at least one of the first component or the second component of the audio recording includes generating a mask representative of the repeating structure in the audio recording and comparing the mask to the audio recording.

In another aspect, the method also includes extracting at least one of the first component or the second component of the audio recording by at least one of separating the first component from the audio recording as portions of the audio recording that do not match the mask or separating the second component from the audio recording as portions of the audio recording that match the mask.

In another embodiment, a method (e.g., for extracting repeating structures, such as patterns, in an audio signal) includes identifying a first temporal period of a first repeating structure in an audio signal, segmenting the audio signal into plural segments based on the first temporal period of the first repeating structure, generating a first repeating segment model that represents the first repeating structure based on the segments of the audio signal, comparing the first repeating segment model to the audio signal to form a mask, and extracting the first repeating structure from the audio signal by applying the mask to the audio signal.

In one aspect, the first temporal period of the first repeating structure represents a periodically repeating occurrence of the first repeating structure in the audio signal.

In one aspect, the first temporal period of the first repeating structure represents a non-periodically repeating occurrence of the first repeating structure in the audio signal.

In one aspect, at least one of segmenting the audio signal, comparing the first repeating segment model, or extracting the first repeating structure is performed on a spectrogram of the audio signal.

In one aspect, identifying the first temporal period includes autocorrelating a spectrogram representative of the audio signal, determining a mean of autocorrelation values of the spectrogram, and measuring the first temporal period between successive repeating peaks in a beat spectrum that represents the means of the autocorrelation values.

In one aspect, the method also includes identifying at least a second temporal period of at least a second repeating structure in the audio signal, segmenting the audio signal into the segments based on the first temporal period and the second temporal period, generating a second repeating segment model that represents the second repeating structure based on one or more of the segments of the audio signal, and comparing the second repeating segment model to the audio signal to extracting the second repeating structure from the audio signal.

In one aspect, generating the first repeating segment model includes determining medians of time-frequency bins of the segments and forming the first repeating segment model such that time-frequency bins of the first repeating segment model represent the medians of the corresponding time-frequency bins of the segments.

In one aspect, comparing the first repeating segment model to the audio signal includes comparing a spectrogram of the audio signal with the first repeating segment model and assigning values to time-frequency bins of the mask that represent differences between time-frequency bins of the spectrogram and corresponding time-frequency bins of the first repeating segment model.

In one aspect, the mask is a binary mask having values of zero or one at time-frequency bins of the mask. The value of zero represents the time-frequency bins that represent the non-repeating structure in the audio signal. The value of one represents the time-frequency bins that represent the first repeating structure in the audio signal. Extracting the first repeating structure can include multiplying the binary mask to a spectrogram of the audio signal.

In another embodiment, a system (e.g., an audio extraction system) includes an identification module, a segmentation module, and a masking module. The identification module is configured to identify a first temporal period of a first repeating structure in an audio signal. The segmentation module is configured to segment the audio signal into plural segments based on the first temporal period of the first repeating structure. The segmentation module also is configured to generate a first repeating segment model that represents the first repeating structure based on the segments of the audio signal. The masking module is configured to compare the first repeating segment model to the audio signal to form a mask and to extract the first repeating structure from the audio signal by applying the mask to the audio signal.

In one aspect, the first temporal period of the first repeating structure represents a periodically repeating occurrence of the first repeating structure in the audio signal.

In one aspect, the first temporal period of the first repeating structure represents a non-periodically repeating occurrence of the first repeating structure in the audio signal.

In one aspect, the segmentation module is configured to generate the first repeating segment model by determining medians of time-frequency bins of the segments and form the first repeating segment model such that time-frequency bins of the first repeating segment model represent the medians of the corresponding time-frequency bins of the segments.

In one aspect, the masking module is configured to compare a spectrogram of the audio signal with the first repeating segment model and to assign values to time-frequency bins of the mask that represent differences between time-frequency bins of the spectrogram and corresponding time-frequency bins of the first repeating segment model.

In another embodiment, a computer readable storage medium comprising one or more sets of instructions is provided. The one or more sets of instructions are configured to direct a processor of a system (e.g., an audio extraction system) to identify a first temporal period of a first repeating structure in an audio signal, segment the audio signal into plural segments based on the first temporal period of the first repeating structure, generate a first repeating segment model that represents the first repeating structure based on the segments of the audio signal, compare the first repeating segment model to the audio signal to form a mask, and extract the first repeating structure from the audio signal by applying the mask to the audio signal.

In one aspect, the first temporal period of the first repeating structure represents a periodically repeating occurrence of the first repeating structure in the audio signal.

In one aspect, the first temporal period of the first repeating structure represents a non-periodically repeating occurrence of the first repeating structure in the audio signal.

In one aspect, the one or more sets of instructions are configured to direct the processor to generate the first repeating segment model by determining medians of time-frequency bins of the segments and to form the first repeating segment model such that time-frequency bins of the first repeating segment model represent the medians of the corresponding time-frequency bins of the segments.

In one aspect, the one or more sets of instructions are configured to direct the processor to compare a spectrogram of the audio signal with the first repeating segment model and to assign values to time-frequency bins of the mask that represent differences between time-frequency bins of the spectrogram and corresponding time-frequency bins of the first repeating segment model.

In another embodiment, a method (e.g., for extracting repeating or similar structure from an audio signal) includes determining a first spectrogram of the audio signal, defining a similarity matrix of the audio signal based on the first spectrogram and a transposed version of the first spectrogram, identifying two or more similar frames in the similarity matrix that are more similar to a designated frame than to one or more other frames in the similarity matrix, creating a repeating spectrogram model based on the two or more similar frames that are identified in the similarity matrix, and deriving a mask based on the repeating spectrogram model and the first spectrogram of the audio signal. The mask is representative of similarities between the repeating spectrogram model and the first spectrogram of the audio signal. The method also includes extracting a repeating structure from the audio signal by applying the mask to the audio signal.

In one aspect, the first spectrogram is a magnitude spectrogram that represents magnitudes of a Short Time Fourier Transform (STFT) of the audio signal.

In one aspect, the first spectrogram is a magnitude spectrogram and defining the similarity matrix is performed by matrix multiplying the magnitude spectrogram by a transposed version of the magnitude spectrogram.

In one aspect, identifying the two or more similar frames includes determining which frames in the similarity matrix are more similar to the designated frame in the similarity matrix than one or more and that are temporally separated by at least a designated time delay, and identifying the frames that are more similar to the designated frame and temporally separated by at least the designated time delay as the two or more similar frames.

In one aspect, creating the repeating spectrogram model includes calculating a median of the two or more similar frames for each of one or more frequency channel of the first spectrogram.

In one aspect, deriving the mask includes creating a refined repeating spectrogram model that represents a comparison of the repeating spectrogram model and the first spectrogram at each of a plurality of time-frequency bins of the repeating spectrogram model and the first spectrogram, and normalizing the refined repeating spectrogram model by the first spectrogram at each of the plurality of time-frequency bins.

In one aspect, the refined repeating spectrogram model represents a minimum between the repeating spectrogram model and the first spectrogram at each of the time-frequency bins.

In one aspect, extracting the repeating structure includes symmetrizing the mask, applying the mask to a Short Time Fourier Transform (STFT) of the audio signal, and inverting the STFT after applying the mask to the STFT.

In another embodiment, a system (e.g., an audio separation system) includes an identification module and a masking module. The identification module is configured to determine a first spectrogram of an audio signal, define a similarity matrix of the audio signal based on the first spectrogram and a transposed version of the first spectrogram, and identify two or more similar frames in the similarity matrix that are more similar to a designated frame than to one or more other frames in the similarity matrix. The identification module also is configured to create a repeating spectrogram model based on the two or more similar frames that are identified in the similarity matrix. The masking module is configured to derive a mask based on the repeating spectrogram model and the first spectrogram of the audio signal. The mask is representative of similarities between the repeating spectrogram model and the first spectrogram of the audio signal. The masking module is further configured to extract a repeating structure from the audio signal by applying the mask to the audio signal.

In one aspect, the identification module is configured to determine the first spectrogram as a magnitude spectrogram that represents magnitudes of a Short Time Fourier Transform (STFT) of the audio signal.

In one aspect, the first spectrogram is a magnitude spectrogram and the identification module is configured to define the similarity matrix by matrix multiplying the magnitude spectrogram by a transposed version of the magnitude spectrogram.

In one aspect, the identification module is configured to identify the two or more similar frames by determining which frames in the similarity matrix are more similar to the designated frame in the similarity matrix than one or more and that are temporally separated by at least a designated time delay and identifying the frames that are more similar to the designated frame and temporally separated by at least the designated time delay as the two or more similar frames.

In one aspect, the identification module is configured to create the repeating spectrogram model by calculating a median of the two or more similar frames for each of one or more frequency channel of the first spectrogram.

In one aspect, the masking module is configured to create a refined repeating spectrogram model that represents a comparison of the repeating spectrogram model and the first spectrogram at each of a plurality of time-frequency bins of the repeating spectrogram model and the first spectrogram and normalize the refined repeating spectrogram model by the first spectrogram at each of the plurality of time-frequency bins.

In one aspect, the refined repeating spectrogram model represents a minimum between the repeating spectrogram model and the first spectrogram at each of the time-frequency bins.

In one aspect, the masking module is configured to extract the repeating structure by symmetrizing the mask, applying the mask to a Short Time Fourier Transform (STFT) of the audio signal, and inverting the STFT after applying the mask to the STFT.

In another embodiment, a computer readable storage medium comprising one or more sets of instructions configured to direct a processor of a system (e.g., an audio separation system) to determine a first spectrogram of an audio signal, define a similarity matrix of the audio signal based on the first spectrogram and a transposed version of the first spectrogram, identify two or more similar frames in the similarity matrix that are more similar to a designated frame than to one or more other frames in the similarity matrix, create a repeating spectrogram model based on the two or more similar frames that are identified in the similarity matrix, and derive a mask based on the repeating spectrogram model and the first spectrogram of the audio signal. The mask is representative of similarities between the repeating spectrogram model and the first spectrogram of the audio signal. The one or more sets of instructions also are configured to direct the processor to extract a repeating structure from the audio signal by applying the mask to the audio signal.

In one aspect, the computer readable storage medium is a tangible and non-transitory computer readable storage medium.

In one aspect, the one or more sets of instructions are configured to direct the processor to determine the first spectrogram as a magnitude spectrogram that represents magnitudes of a Short Time Fourier Transform (STFT) of the audio signal.

In one aspect, the first spectrogram is a magnitude spectrogram and the one or more sets of instructions are configured to direct the processor to define the similarity matrix by matrix multiplying the magnitude spectrogram by a transposed version of the magnitude spectrogram.

In one aspect, the one or more sets of instructions are configured to direct the processor to identify the two or more similar frames by determining which frames in the similarity matrix are more similar to the designated frame in the similarity matrix than one or more and that are temporally separated by at least a designated time delay, and identifying the frames that are more similar to the designated frame and temporally separated by at least the designated time delay as the two or more similar frames.

In one aspect, the one or more sets of instructions are configured to direct the processor to create the repeating spectrogram model by calculating a median of the two or more similar frames for each of one or more frequency channel of the first spectrogram.

In one aspect, the one or more sets of instructions are configured to direct the processor to derive the mask by creating a refined repeating spectrogram model that represents a comparison of the repeating spectrogram model and the first spectrogram at each of a plurality of time-frequency bins of the repeating spectrogram model and the first spectrogram, and normalizing the refined repeating spectrogram model by the first spectrogram at each of the plurality of time-frequency bins.

In one aspect, the refined repeating spectrogram model represents a minimum between the repeating spectrogram model and the first spectrogram at each of the time-frequency bins.

In one aspect, the one or more sets of instructions are configured to direct the processor to extract the repeating structure by symmetrizing the mask, applying the mask to a Short Time Fourier Transform (STFT) of the audio signal, and inverting the STFT after applying the mask to the STFT.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the subject matter described herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose several embodiments of the inventive subject matter and also to enable any person of ordinary skill in the art to practice the embodiments disclosed herein, including making and using any devices or systems and performing any incorporated methods. The patentable scope of the subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the disclosed subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, and the like). Similarly, the programs may be stand alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the present inventive subject matter are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the above-described systems and methods, without departing from the spirit and scope of the subject matter herein involved, it is intended that all of the subject matter of the above description or shown in the accompanying drawings shall be interpreted merely as examples illustrating the inventive concepts herein and shall not be construed as limiting the disclosed subject matter.

The invention claimed is:

1. A method comprising:

determining a first spectrogram of an audio signal;

defining a similarity matrix of the audio signal based on the first spectrogram and a transposed version of the first spectrogram;

identifying two or more similar frames in the similarity matrix that are more similar to a designated frame than to one or more other frames in the similarity matrix;

creating a repeating spectrogram model based on the two or more similar frames that are identified in the similarity matrix;

deriving a mask based on the repeating spectrogram model and the first spectrogram of the audio signal, the mask representative of similarities between the repeating spectrogram model and the first spectrogram of the audio signal; and extracting a repeating structure from the audio signal by applying the mask to the audio signal.

2. The method of claim 1, wherein the first spectrogram is a magnitude spectrogram that represents magnitudes of a Short Time Fourier Transform (STFT) of the audio signal.

3. The method of claim 1, wherein the first spectrogram is a magnitude spectrogram and defining the similarity matrix is performed by matrix multiplying the magnitude spectrogram by a transposed version of the magnitude spectrogram.

4. The method of claim 1, wherein identifying the two or more similar frames includes: determining which frames in the similarity matrix are more similar to the designated frame in the similarity matrix than the one or more other frames and that are temporally separated by at least a designated time delay; and identifying the frames that are more similar to the designated frame and temporally separated by at least the designated time delay as the two or more similar frames.

5. The method of claim 1, wherein creating the repeating spectrogram model includes calculating a median of the two or more similar frames for each of one or more frequency channels of the first spectrogram.

6. The method of claim 1, wherein deriving the mask includes: creating a refined repeating spectrogram model that represents a comparison of the repeating spectrogram model and the first spectrogram at each of a plurality of time-frequency bins of the repeating spectrogram model and the first spectrogram; and normalizing the refined repeating spectrogram model by the first spectrogram at each of the plurality of time-frequency bins.

7. The method of claim 6, wherein the refined repeating spectrogram model represents a minimum between the repeating spectrogram model and the first spectrogram at each of the time-frequency bins.

8. The method of claim 1, wherein extracting the repeating structure includes symmetrizing the mask, applying the mask to a Short Time Fourier Transform (STFT) of the audio signal, and inverting the STFT after applying the mask to the STFT.

9. A system comprising:

a processor and a memory, the memory storing instructions which, when executed by the processor, cause the processor to implement:

an identification module configured to determine a first spectrogram of an audio signal, define a similarity matrix of the audio signal based on the first spectrogram and a transposed version of the first spectrogram, and identify two or more similar frames in the similarity matrix that are more similar to a designated frame than to one or more other frames in the similarity matrix, the identification module also configured to create a repeating spectrogram model based on the two or more similar frames that are identified in the similarity matrix; and a masking module configured to derive a mask based on the repeating spectrogram model and the first spectrogram of the audio signal, the mask representative of similarities between the repeating spectrogram model and the first spectrogram of the audio signal, the masking module further configured to extract a repeating structure from the audio signal by applying the mask to the audio signal.

10. The system of claim 9, wherein the identification module is configured to determine the first spectrogram as a magnitude spectrogram that represents magnitudes of a Short Time Fourier Transform (STFT) of the audio signal.

11. The system of claim 9, wherein the first spectrogram is a magnitude spectrogram and the identification module is configured to define the similarity matrix by matrix multiplying the magnitude spectrogram by a transposed version of the magnitude spectrogram.

12. The system of claim 9, wherein the identification module is configured to identify the two or more similar frames by determining which frames in the similarity matrix are more similar to the designated frame in the similarity matrix than the one or more other frames and that are temporally separated by at least a designated time delay and identifying the frames that are more similar to the designated frame and temporally separated by at least the designated time delay as the two or more similar frames.

13. The system of claim 9, wherein the identification module is configured to create the repeating spectrogram model by calculating a median of the two or more similar frames for each of one or more frequency channels of the first spectrogram.

14. The system of claim 9, wherein the masking module is configured to create a refined repeating spectrogram model that represents a comparison of the repeating spectrogram model and the first spectrogram at each of a plurality of time-frequency bins of the repeating spectrogram model and the first spectrogram and normalize the refined repeating spectrogram model by the first spectrogram at each of the plurality of time-frequency bins.

15. The system of claim 14, wherein the refined repeating spectrogram model represents a minimum between the repeating spectrogram model and the first spectrogram at each of the time-frequency bins.

16. The system of claim 9, wherein the masking module is configured to extract the repeating structure by symmetrizing the mask, applying the mask to a Short Time Fourier Transform (STFT) of the audio signal, and inverting the STFT after applying the mask to the STFT.

17. A non-transitory computer readable storage medium comprising one or more sets of instructions configured to direct a processor of a system to:

determine a first spectrogram of an audio signal;

define a similarity matrix of the audio signal based on the first spectrogram and a transposed version of the first spectrogram;

identify two or more similar frames in the similarity matrix that are more similar to a designated frame than to one or more other frames in the similarity matrix;

create a repeating spectrogram model based on the two or more similar frames that are identified in the similarity matrix;

derive a mask based on the repeating spectrogram model and the first spectrogram of the audio signal, the mask representative of similarities between the repeating spectrogram model and the first spectrogram of the audio signal; and extract a repeating structure from the audio signal by applying the mask to the audio signal.

18. The computer readable storage medium of claim 17, wherein the one or more sets of instructions are configured to direct the processor to determine the first spectrogram as a magnitude spectrogram that represents magnitudes of a Short Time Fourier Transform (STFT) of the audio signal.

19. The computer readable storage medium of claim 17, wherein the first spectrogram is a magnitude spectrogram and the one or more sets of instructions are configured to direct the processor to define the similarity matrix by matrix multiplying the magnitude spectrogram by a transposed version of the magnitude spectrogram.

20. The computer readable storage medium of claim 17, wherein the one or more sets of instructions are configured to direct the processor to identify the two or more similar frames by: determining which frames in the similarity matrix are more similar to the designated frame in the similarity matrix than the one or more other frames and that are temporally separated by at least a designated time delay; and identifying the frames that are more similar to the designated frame and temporally separated by at least the designated time delay as the two or more similar frames.

21. The computer readable storage medium of claim 17, wherein the one or more sets of instructions are configured to direct the processor to create the repeating spectrogram model by calculating a median of the two or more similar frames for each of one or more frequency channels of the first spectrogram.

22. The computer readable storage medium of claim 17, wherein the one or more sets of instructions are configured to direct the processor to derive the mask by:

creating a refined repeating spectrogram model that represents a comparison of the repeating spectrogram model and the first spectrogram at each of a plurality of time-frequency bins of the repeating spectrogram model and the first spectrogram; and normalizing the refined repeating spectrogram model by the first spectrogram at each of the plurality of time-frequency bins.

23. The computer readable storage medium of claim 22, wherein the refined repeating spectrogram model represents a minimum between the repeating spectrogram model and the first spectrogram at each of the time-frequency bins.

24. The computer readable storage medium of claim 17, wherein the one or more sets of instructions are configured to direct the processor to extract the repeating structure by symmetrizing the mask, applying the mask to a Short Time Fourier Transform (STFT) of the audio signal, and inverting the STFT after applying the mask to the STET.

* * * * *